US009085433B2

(12) United States Patent
Aoki et al.

(10) Patent No.: US 9,085,433 B2
(45) Date of Patent: Jul. 21, 2015

(54) MEDIUM TRANSPORT DEVICE AND RECORDING DEVICE

(71) Applicant: SEIKO EPSON CORPORATION, Tokyo (JP)

(72) Inventors: Takeshi Aoki, Matsumoto (JP); Katsumi Okamoto, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/470,068

(22) Filed: Aug. 27, 2014

(65) Prior Publication Data

US 2015/0061216 A1 Mar. 5, 2015

(30) Foreign Application Priority Data

Sep. 3, 2013 (JP) ..... 2013-181900

(51) Int. Cl.

| | |
|---|---|
| ***B65H 5/00*** | (2006.01) |
| ***B65H 5/36*** | (2006.01) |
| ***B41J 11/00*** | (2006.01) |
| ***B65H 1/02*** | (2006.01) |
| ***B65H 9/00*** | (2006.01) |
| ***B65H 7/12*** | (2006.01) |
| ***G03G 21/16*** | (2006.01) |

(52) U.S. Cl.

CPC ..... *B65H 5/36* (2013.01); *B41J 11/006* (2013.01); *B65H 1/027* (2013.01); *B65H 7/12* (2013.01); *B65H 9/00* (2013.01); *G03G 21/16* (2013.01); *G03G 21/1623* (2013.01); *G03G 21/1633* (2013.01); *B65H 2402/10* (2013.01); *B65H 2402/30* (2013.01); *B65H 2402/31* (2013.01); *B65H 2402/32* (2013.01); *B65H 2402/40* (2013.01); *B65H 2402/44* (2013.01); *B65H 2402/441* (2013.01); *B65H 2402/45* (2013.01); *B65H 2404/50* (2013.01); *B65H 2404/60* (2013.01); *B65H 2404/74* (2013.01); *G03G 2215/00544* (2013.01); *G03G 2221/169* (2013.01); *G03G 2221/1672* (2013.01); *G03G 2221/1684* (2013.01); *G03G 2221/1687* (2013.01)

(58) Field of Classification Search

CPC ..... B65H 3/66; B65H 3/68; B65H 5/00; B65H 5/36; B65H 5/38; B65H 29/52; B65H 2402/10; B65H 2402/30; B65H 2402/31; B65H 2402/32; B65H 2402/40; B65H 2402/44; B65H 2402/441; B65H 2402/45; B65H 2404/50; B65H 2404/60; B65H 2404/74; B65H 2404/741; B65H 2404/7414; G03G 21/16; G03G 21/1623; G03G 21/1633; G03G 2215/00544; G03G 2221/1672; G03G 2221/1684; G03G 2221/1687; G03G 2221/169; B41J 11/006

See application file for complete search history.

(56) References Cited

U.S. PATENT DOCUMENTS

| | | | | |
|---|---|---|---|---|
| 2009/0194931 | A1* | 8/2009 | Shiohara et al. | 271/8.1 |
| 2010/0239271 | A1* | 9/2010 | Kawamura et al. | 399/21 |

(Continued)

FOREIGN PATENT DOCUMENTS

| | | |
|---|---|---|
| JP | 2002-174998 | 6/2002 |
| JP | 2008-116479 | 5/2008 |

*Primary Examiner* — Prasad Gokhale

(74) *Attorney, Agent, or Firm* — Workman Nydegger

(57) ABSTRACT

A medium transport device includes a restricting unit that is provided in a device main body, and that is coupled with an attaching and detaching operation of a unit body, which configures a portion of a transport pathway, to the device main body. The restricting unit changes between a first state that allows the cover to attain a closed state with respect to the device main body and a second state that restricts the cover from attaining a closed state with respect to the device main body.

7 Claims, 15 Drawing Sheets

(56) References Cited

U.S. PATENT DOCUMENTS

2011/0206441 A1* 8/2011 Mizuguchi et al. ..... 400/642
2011/0236099 A1* 9/2011 Yamamoto ..... 399/388
2015/0061215 A1* 3/2015 Aoki et al. ..... 271/254

* cited by examiner

MEDIUM TRANSPORT DEVICE AND RECORDING DEVICE

BACKGROUND

1. Technical Field

The present invention relates to a medium transport device and recording device that are typical of facsimiles, printers, and the like.

2. Related Art

In recording devices of the related art that are typical of facsimiles, printers, and the like, when paper jams and transport faults occur in a transport pathway of a target recording medium, in order to clear a target recording medium that is jammed in the middle of a route of the transport pathway, clearing of the target recording medium that is jammed in the middle of the route of the transport pathway is performed by providing a cover that is openable and closeable with respect to the device main body, and exposing at least a portion of the transport pathway of the target recording medium by opening the cover with respect to the device main body.

In such recording devices, for example, it is possible to unitize a portion of the transport pathway, and configure the portion of the transport pathway to be attachable and detachable with respect to the device main body in a state in which the cover is open with respect to the device main body. According to this configuration, it is possible to easily remove a target recording medium that has caused a paper jam in the recording device from the transport pathway.

Given that, in a recording device with this configuration, by closing the cover with respect to the device main body in a state in which the unit has been disengaged from the device main body, there were circumstances in which a user would operate the recording device without realizing that the unit was yet to be installed in the device main body. As a result of this, there was a concern that transport faults of the target recording medium would occur in the recording device.

In addition, since the recording device being operated in an unprepared manner in a state in which the cover are open becomes a safety issue and a cause of further paper jamming, a detector such as a sensor for detecting that the cover are definitely close with respect to the device main body, is provided.

Given that, in a recording device that is provided with this kind of detector, in a case of a configuration that detects that the cover is closed when the detector comes into contact with a side of one end of the cover in the width direction, or when the detector is close to a side of one end of the cover, for example, in a case in which the cover has a low rigidity, there is a concern that, even if the cover is crooked and a side of the other end thereof is not closed with respect to the device main body due to some factor or another, the detector will detect the side of one end of the cover, falsely recognize that the cover is closed with respect to the device main body, and operation of the recording device will be initiated.

In such an instance, there is a recording device that can only close the cover with respect to the device main body in a state in which a unit body, which is attachable and detachable with respect to the device main body, is fixed to the device main body (JP-A-2008-116479). In this recording device, a plurality of toner containers are configured to be fixable to the device main body, the recording device is configured to slide a locking plate from an attaching and detaching position to a fixing position by rotating a lever member when the toner containers are fixed to the device main body.

Further, a presence or absence detection mechanism, in which closing of the cover with respect to the device main body is restricted when the locking plate is in the attaching and detaching position, and closing of the cover with respect to the device main body is allowed when the locking plate is in the fixing position, is provided in the device main body, and the presence or absence detection mechanism in all of the plurality of toner containers is configured so that it is not possible to close the cover with respect to the device main body if the locking plate is not in the fixing position.

However, in this recording device, it is necessary for a user to rotate a lever member that corresponds to each toner container when the toner containers are attached and detached. Therefore, it is necessary for a user to manipulate the lever members after fixing the toner containers to the device main body. As a result of this, the workability of the recording device is reduced.

In addition, in this recording device, in a case of configuring, in the abovementioned manner, a portion of the transport pathway as a unit body that is attachable and detachable instead of the toner containers, in order to clear a target recording medium that is jammed when a paper jam occurs in the transport pathway, it is necessary to open the cover with respect to the device main body, and further perform a removal operation by manipulating the lever member. In addition, after disengaging the unit body with respect to the device main body and removing sheets that are jammed, manipulation of the lever member is also necessary when fixing the unit body to the device main body again. Therefore, in this recording device, since manipulation of the lever member is also necessary in addition to merely opening and closing the cover, there is a deterioration in workability.

SUMMARY

An advantage of some aspects of the invention is to provide a recording device that can restrict closing of a cover with respect to a device main body in a state in which a unit body is not installed in the device main body when the cover is closed with respect to the device main body, and can improve workability.

According to a first aspect of the invention, there is provided a medium transport device including a device main body that is provided with a transport unit that transports a medium, a transport pathway that configures the transport unit, an opening and closing body that is openable and closeable with respect to the device main body, an installation unit that is provided in the device main body, and is exposed when the opening and closing body is open with respect to the device main body, a unit body that is attachable and detachable with respect to the installation unit in a state in which the installation unit is exposed, and that configures a portion of the transport pathway in a state of being installed in the installation unit, and a restricting unit that is provided in the device main body, and that changes between a first state that allows the opening and closing body to attain a closed state with respect to the device main body and a second state that restricts the opening and closing body from attaining a closed state with respect to the device main body in tandem with an attaching and detaching operation of the unit body with respect to the device main body.

According to the aspect of the invention, it is possible to restrict closing of the opening and closing body in a state in which the unit body is yet to be installed in the device main body. In addition, since it is not possible to close the opening and closing body with respect to the device main body, it is possible for a user to easily confirm that the unit body is yet to be installed in the device main body. In addition, since the restricting unit changes from the first state to the second state in tandem with a removal action of the unit body from the installation unit, workability is improved without it being necessary for a user to manipulate the restricting unit.

In the medium transport device of a second aspect of the invention, according to the first aspect, the opening and closing body may be provided with a target restricting unit that is provided facing a device main body side, and that follows a track that is established according to an opening and closing operation of the opening and closing body. In the first state, the restricting unit may migrate to a position that is shifted away from the track of the target restricting unit, and, in the second state, the restricting unit may be positioned on the track of the target restricting unit.

In the medium transport device of a third aspect of the invention, according to the second aspect, the restricting unit may be provided in a swinging member. The swinging member may swing in tandem with the attaching and detaching operation of the unit body with respect to the device main body. The swinging member may position the restricting unit in the first state by swinging in tandem with an installation operation of the unit body to the device main body. Furthermore, the swinging member may position the restricting unit in the second state by swinging in tandem with a removal operation of the unit body from the device main body.

In the medium transport device of a fourth aspect of the invention, according to the third aspect, the swinging member may achieve the first state of abutting against the unit body as a result of the installation operation of the unit body in the device main body. Further, the swinging member may achieve the second state of swinging under its own weight as a result of the removal operation of the unit body from the device main body.

In the medium transport device of a fifth aspect of the invention, according to the second aspect, the restricting unit may be provided in a sliding member. The sliding member may slide in tandem with the attaching and detaching operation of the unit body with respect to the device main body. The sliding member may position the restricting unit in the first state by sliding in tandem with an installation operation of the unit body to the device main body. In addition, the sliding member may position the restricting unit in the second state by sliding in tandem with a removal operation of the unit body from the device main body.

In the medium transport device of a sixth aspect of the invention, according to the fifth aspect, the sliding member may achieve the first state of abutting against the unit body as a result of the installation operation of the unit body in the device main body. Further, the sliding member may achieve the second state of sliding under its own weight as a result of the removal operation of the unit body from the device main body.

According to a seventh aspect of the invention, there is provided a recording device including a recording unit which is provided in the device main body of the first aspect, in which the recording device executes recording on a medium that is transported by a transport unit using the recording unit.

According to an eighth aspect of the invention, there is provided a recording device including a device main body in which a recording head, which performs recording on a target recording medium, is provided, an opening and closing body that is openable and closeable with respect to the device main body, an installation unit that is provided in the device main body, and is exposed when the opening and closing body is open with respect to the device main body, a unit body that is attachable and detachable with respect to the installation unit in a state in which the installation unit is exposed, and that configures a portion of a transport pathway of the target recording medium in a state of being installed in the installation unit, and a restricting unit that is provided on a device main body side, and that can take on a first state that allows the opening and closing body to attain a closed state with respect to the device main body and a second state that restricts the opening and closing body from attaining a closed state with respect to the device main body depending on the attachment or detachment of the unit body to the device main body, in which the restricting unit takes on the first state in a state in which the unit body is installed in the installation unit, and changes from the first state to the second state in tandem with a removal action of the unit body from the installation unit when the unit body is removed from the installation unit.

According to the aspect of the invention, the unit body that configures a portion of the transport pathway is configured to be attachable and detachable with respect to the device main body. The restricting unit that is provided on a device main body side can take on the first state that allows the opening and closing body to attain a closed state with respect to the device main body and the second state that restricts the opening and closing body from attaining a closed state with respect to the device main body depending on the attachment or detachment of the unit body to the device main body. The restricting unit changes from the first state to the second state in tandem with a removal action of the unit body from the installation unit when the unit body is removed from the installation unit. As a result of this, the restricting unit can restrict closing of the opening and closing body in a state in which the unit body is yet to be installed in the device main body. In addition, since it is not possible to close the opening and closing body with respect to the device main body, it is possible for a user to easily confirm that the unit body is yet to be installed in the device main body. In addition, since the restricting unit changes from the first state to the second state in tandem with a removal action of the unit body from the installation unit, workability is improved without it being necessary for a user to manipulate the restricting unit.

In the recording device of a ninth aspect of the invention, according to the eighth aspect, the restricting unit may change from the first state to the second state under its own weight.

According to the aspect of the invention, since the restricting unit changes from the first state to the second state under its own weight, it is possible to make the configuration of the restricting unit simple.

In the recording device of a tenth aspect of the invention, according to the ninth aspect, the restricting unit may be provided in a swinging member that is capable of swinging with a swinging axis as the center thereof, and the restricting unit may take on the first state and the second state as a result of the swinging of the swinging member.

According to the aspect of the invention, since the restricting unit is provided in the swinging member, and changes from the first state to the second state as a result of the swinging of the swinging member, it is possible to reliably retain the second state when the unit body is in an uninstalled state with respect to the device main body, and it is possible to reliably restrict closing of the opening and closing body in the device main body.

In the recording device of an eleventh aspect of the invention, according to the ninth aspect, the restricting unit may be provided in a sliding member that slides along a height direction of the device main body, and the restricting unit may take on the first state and the second state as a result of the sliding of the sliding member in the height direction.

According to the aspect of the invention, since the restricting unit is provided in the sliding member, and changes from the first state and the second state as a result of the sliding of the sliding member in the height direction of the device main body, it is possible to reliably retain the second state when the unit body is in an uninstalled state with respect to the device main body, and it is possible to reliably restrict closing of the opening and closing body in the device main body.

In the recording device of a twelfth aspect of the invention, according to the tenth or eleventh aspects, a biasing unit that biases the restricting unit toward the second state from the first state may be further provided.

According to the aspect of the invention, since a biasing unit that biases the restricting unit toward the second state from the first state are further provided, it is possible to make the change to the second state from the first state reliable. As a result of this, it is possible to reliably retain the second state when the unit body is in an uninstalled state with respect to the device main body, and it is possible to reliably restrict closing of the opening and closing body in the device main body.

In the recording device of a thirteenth aspect of the invention, according to any one of the eighth to twelfth aspects, the restricting unit may be displaced from the second state to the first state in tandem with an action that installs the unit body in the installation unit when the unit body is installed in the installation unit.

According to the aspect of the invention, since the restricting unit is displaced from the second state to the first state in tandem with an action that installs the unit body in the installation unit when the unit body is installed in the installation unit, workability is improved without it being necessary for a user to manipulate the restricting unit.

In the recording device of a fourteenth aspect of the invention, according to any one of the eighth to thirteenth aspects, a detector that detects whether the opening and closing body is in a closed state with respect to the device main body, may be provided in at least either one of the device main body or the opening and closing body, the restricting unit may be disposed in the installation unit on a side of one end in a direction that intersects a transport direction of the target recording medium, and the detector may be disposed on the side of the end on which the restricting unit is disposed.

According to the aspect of the invention, since the detector that detects whether the opening and closing body is in a closed state with respect to the device main body, and the restricting unit are disposed in the installation unit on the same side in a direction that intersects the transport direction of the target recording medium, it is possible to reduce false detection of the open and closed states of the opening and closing body with respect to the device main body. Therefore, it is possible to prevent operation of the recording device in a state in which the opening and closing body is not closed normally with respect to the device main body.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
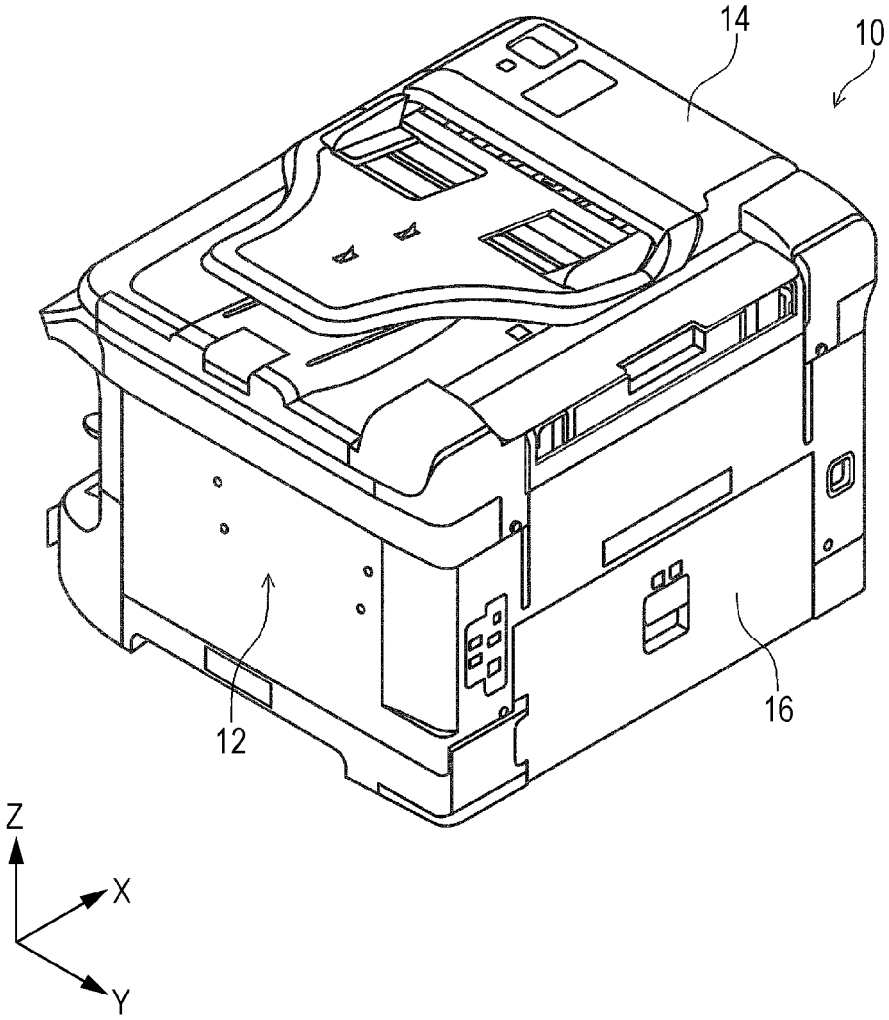
FIG. 1 is a rear surface side perspective view of a printer according to the invention.

Hereinafter, examples of the invention will be described on the basis of the drawings. Additionally, similar configurations in each example will be given the same reference numeral, and descriptions of the configurations thereof will only be given in the first example in which they appear with further descriptions being omitted from later examples.

Figure 2:
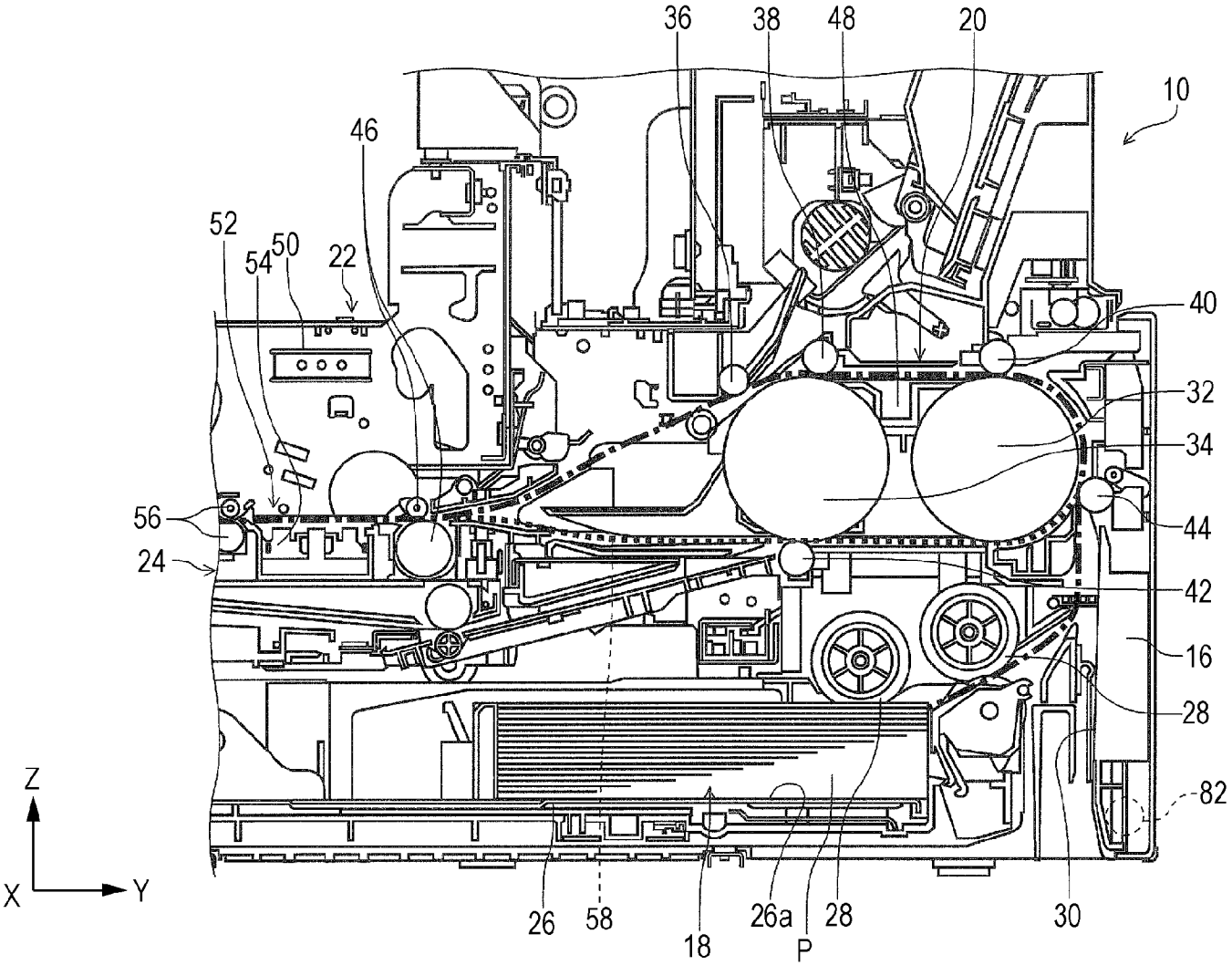
FIG. 2 is a sectional side view that shows a sheet transport pathway of the printer according to the invention.
Figure 3:
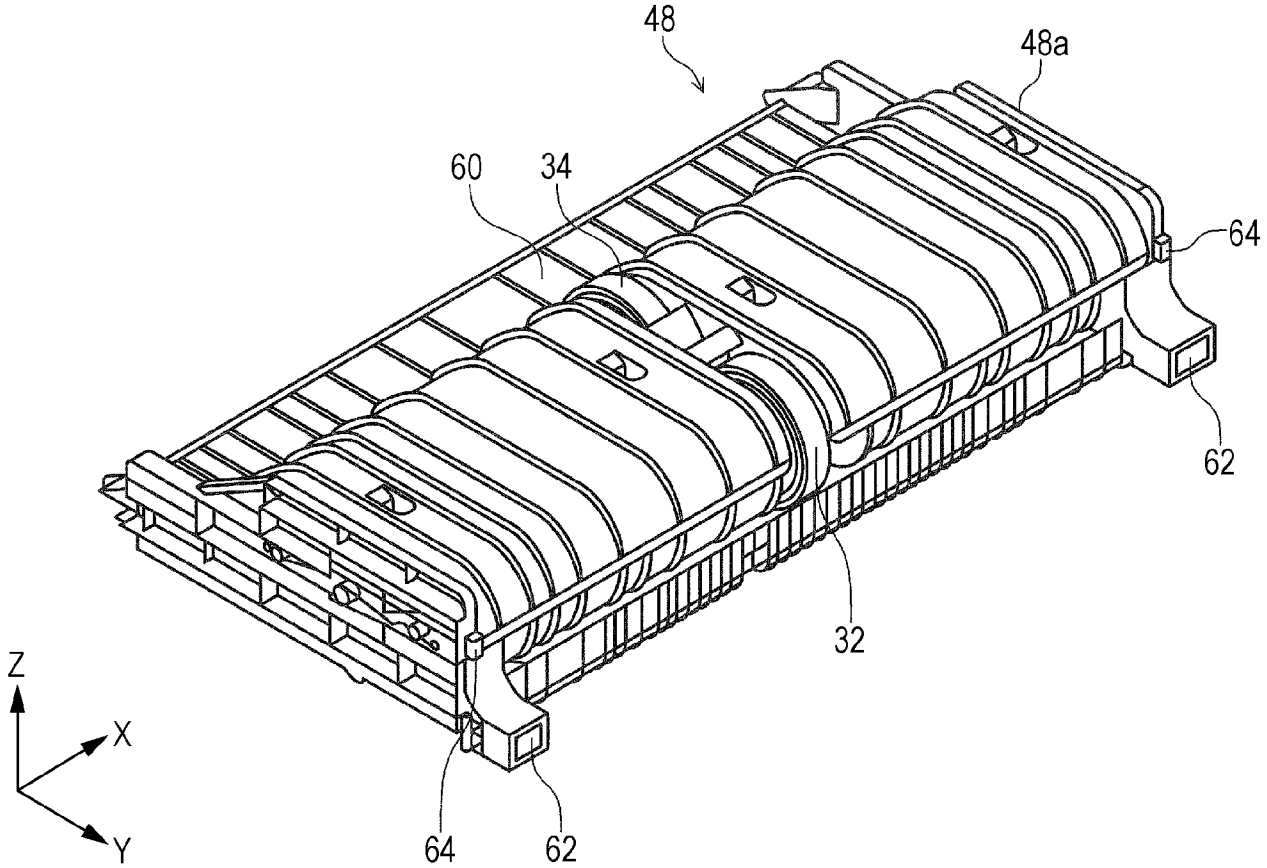
FIG. 3 is a rear surface side perspective view of a unit body in a first example.
Figure 4:
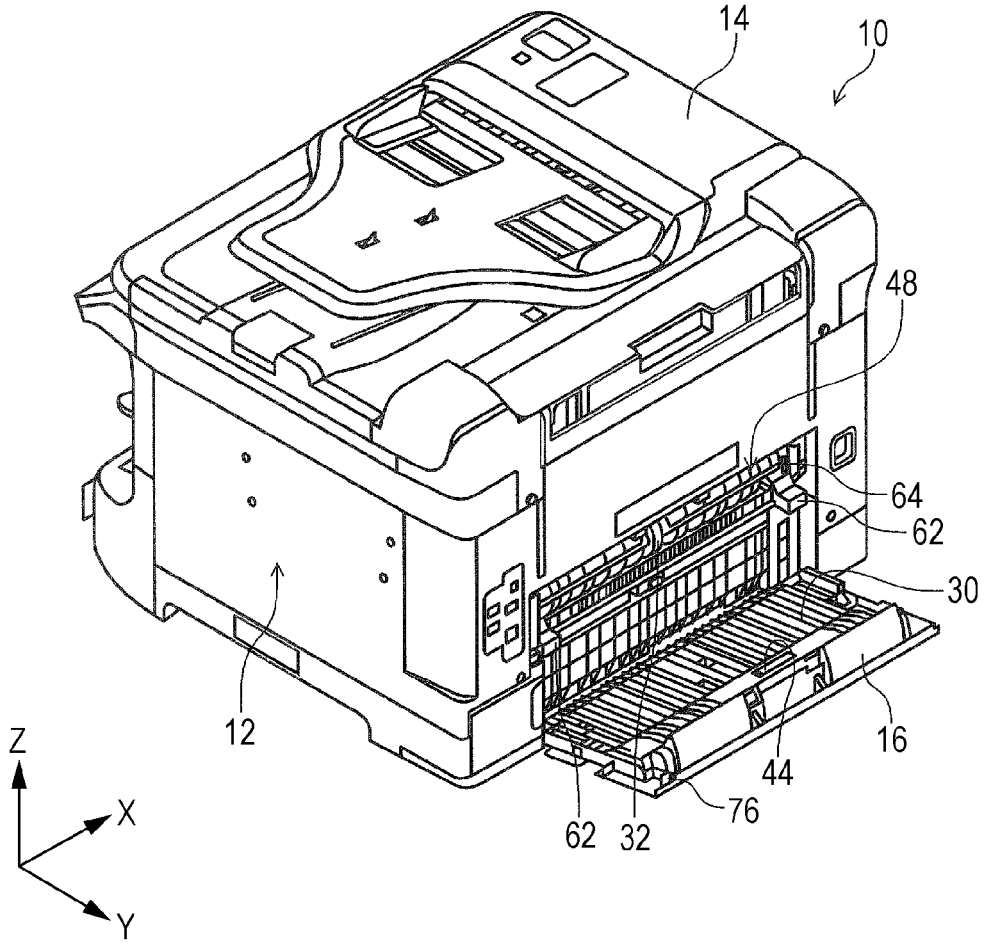
FIG. 4 is a perspective view that shows a state in the first example in which a rear surface cover is open with respect to a device main body.
Figure 5:
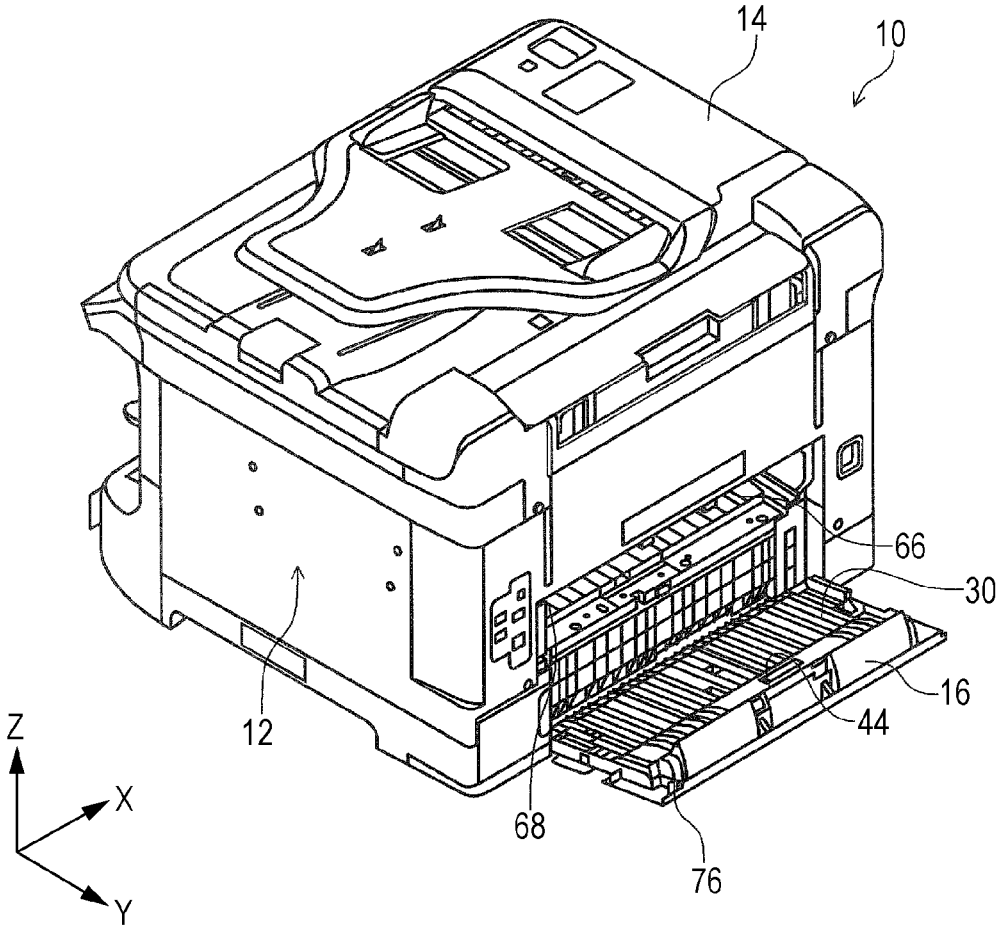
FIG. 5 is a perspective view that shows a state in the first example in which the rear surface cover is open with respect to the device main body and the unit body is removed from the device main body.

FIG. 1 is a rear surface side perspective view of a printer according to the invention, FIG. 2 is a sectional side view that shows a sheet transport pathway of the printer according to the invention, FIG. 3 is a rear surface side perspective view of a unit body in a first example, FIG. 4 is a perspective view that shows a state in the first example in which a rear surface cover is open with respect to a device main body, and FIG. 5 is a perspective view that shows a state in the first example in which the rear surface cover is open with respect to the device main body and the unit body is removed from the device main body.

Figure 6A:
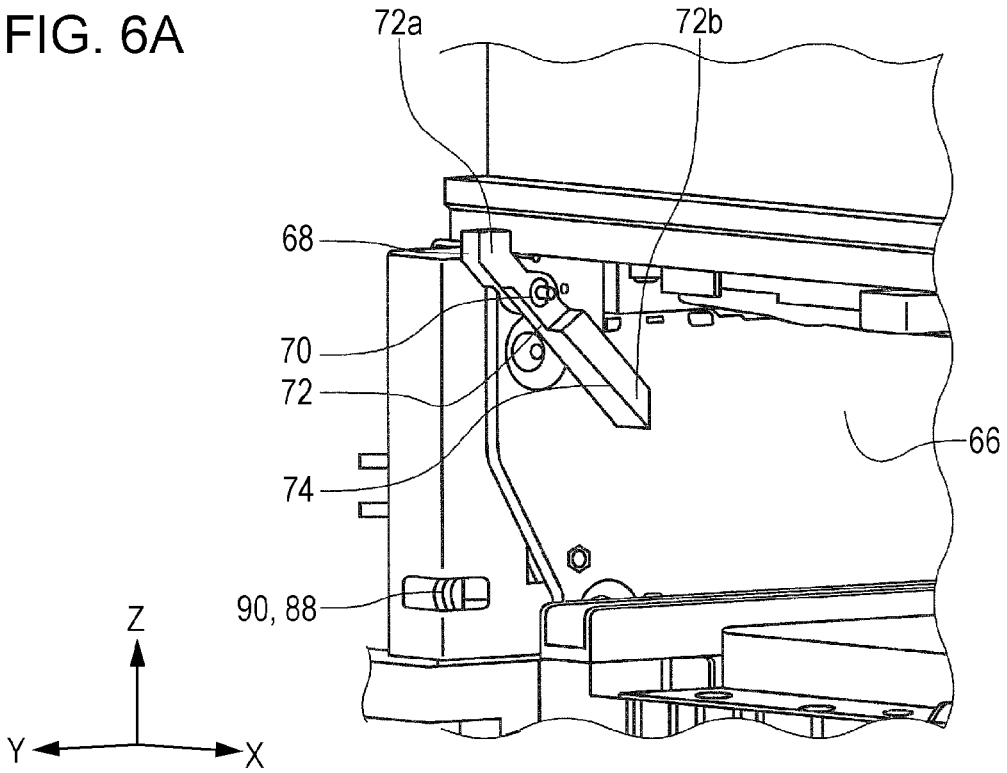
FIG. 6A is a perspective view of a restricting unit in the first example.
Figure 6B:
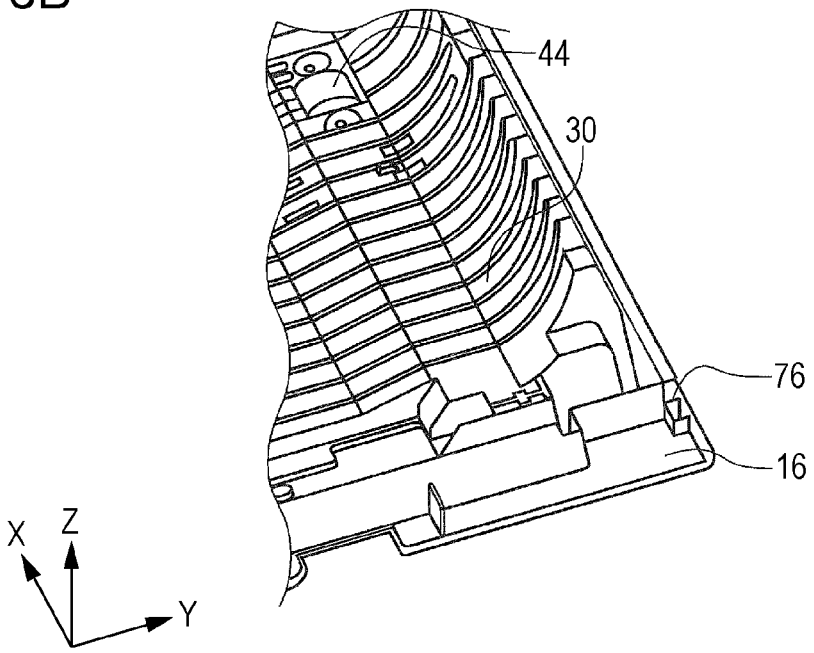
FIG. 6B is a perspective view of a target engaging unit that engages with the restricting unit on the rear surface cover.
Figure 7A:
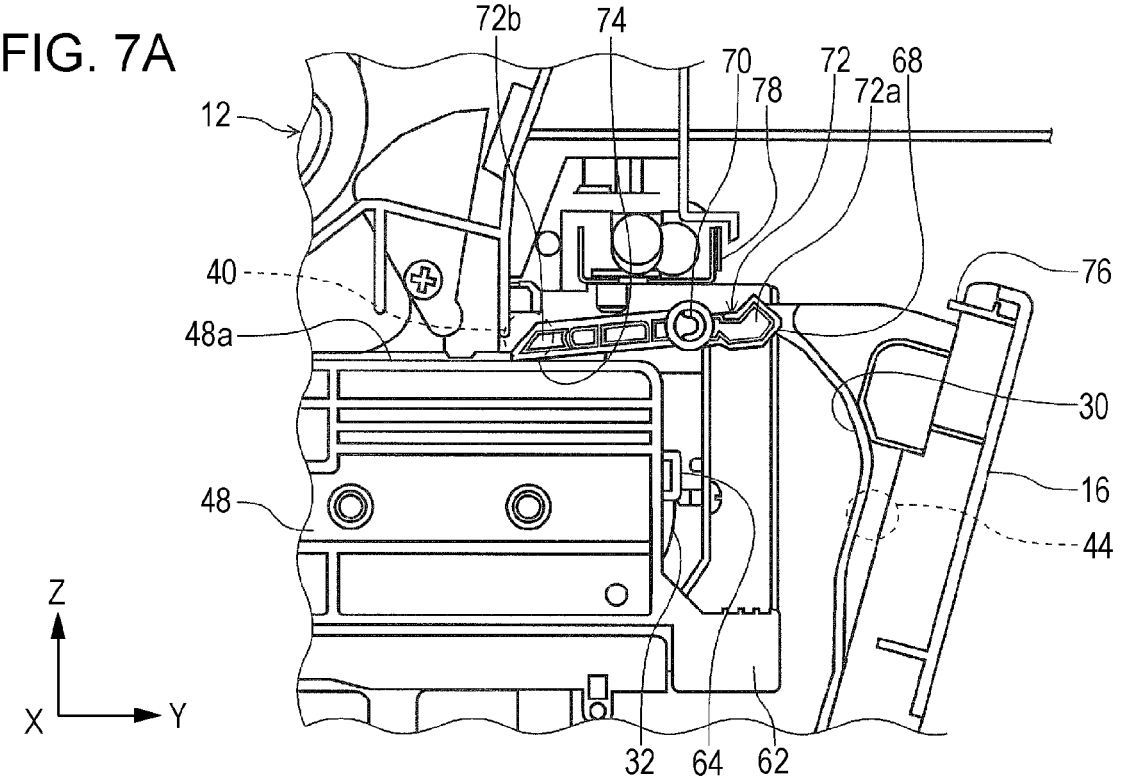
FIG. 7A is a lateral view that shows a first state of the restricting unit.
Figure 7B:
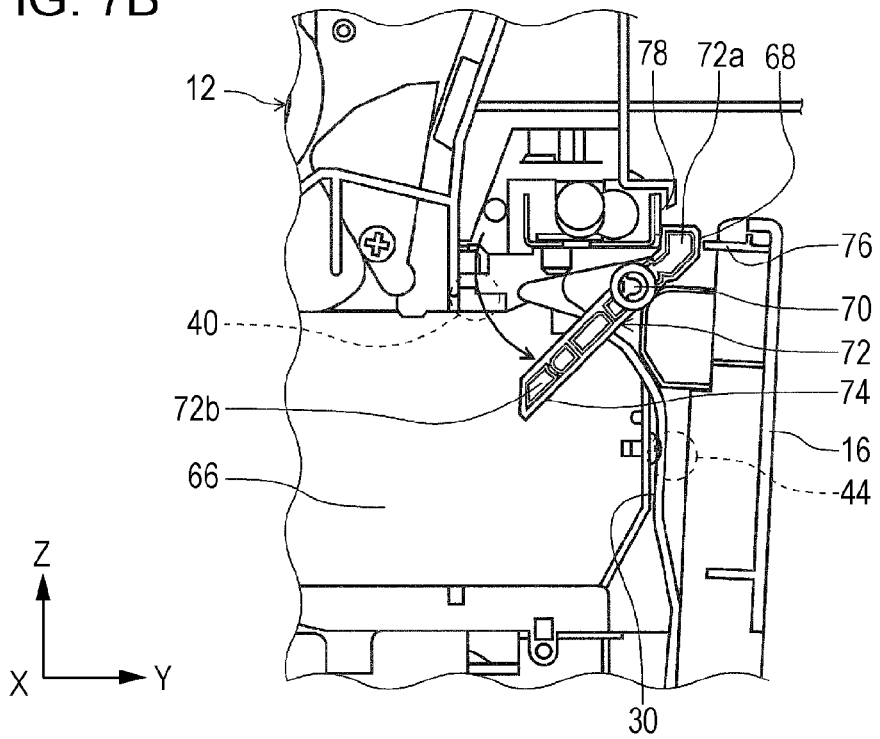
FIG. 7B is a lateral view that shows a second state of the restricting unit.
Figure 8:
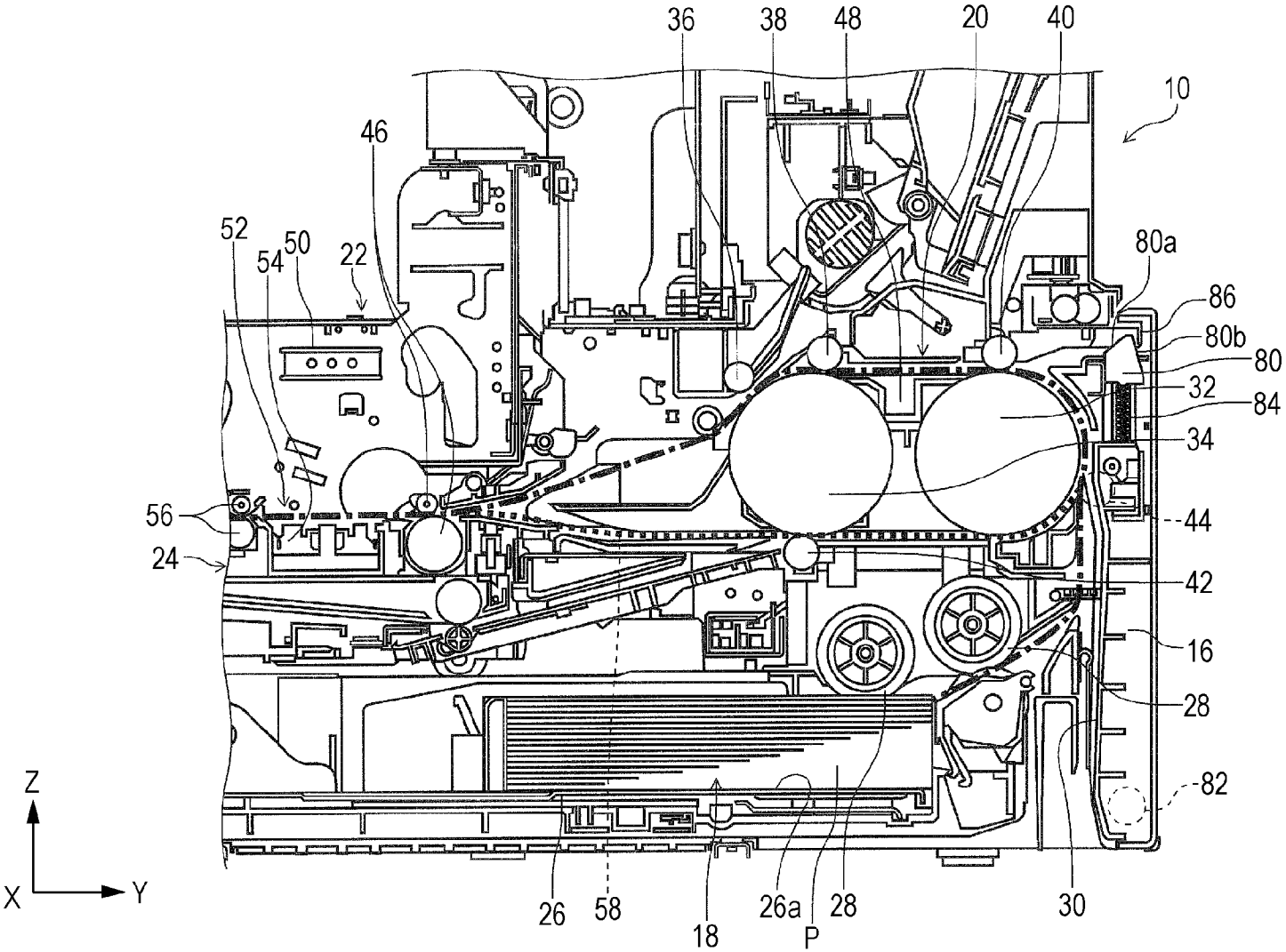
FIG. 8 is an outline view that shows a rear surface cover biasing member that is provided on the rear surface cover.
Figure 9:
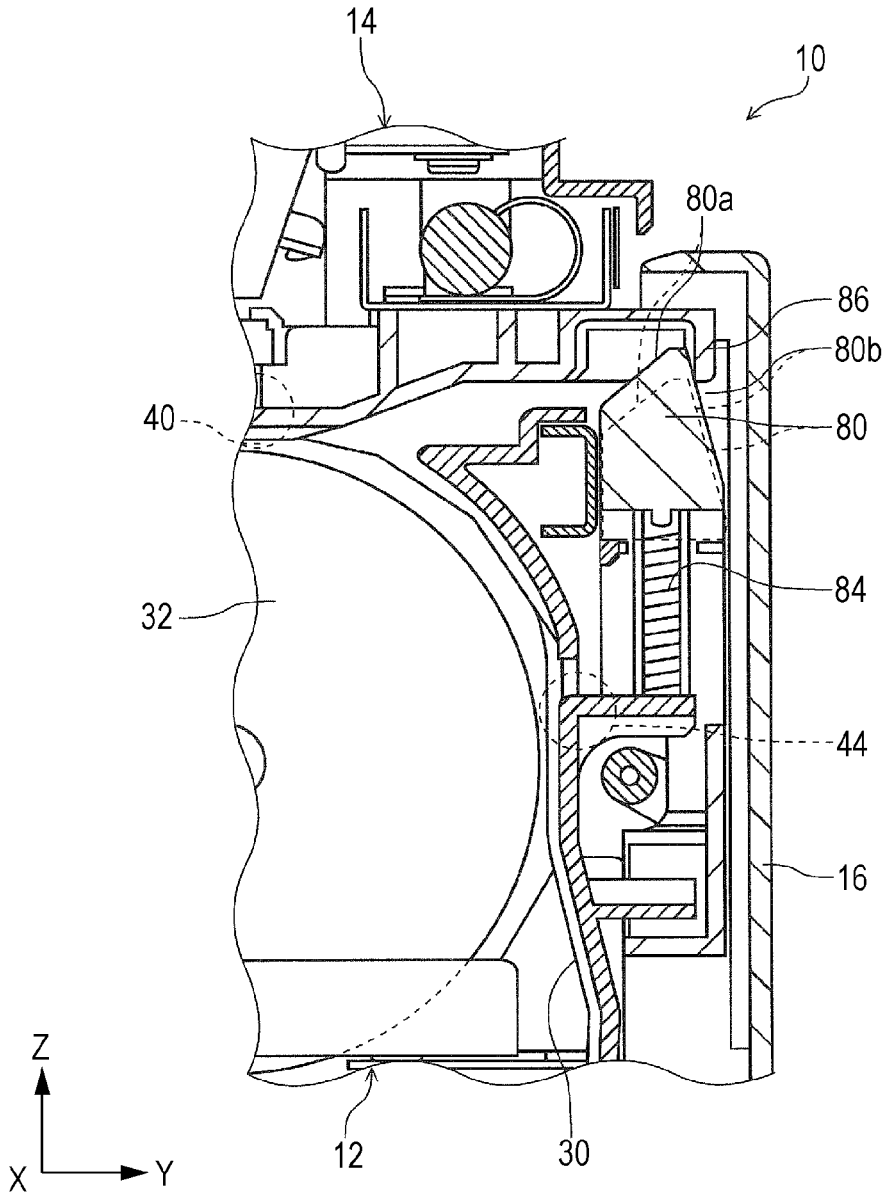
FIG. 9 is an enlarged view that shows the rear surface cover biasing member that is provided on the rear surface cover.
Figure 10:
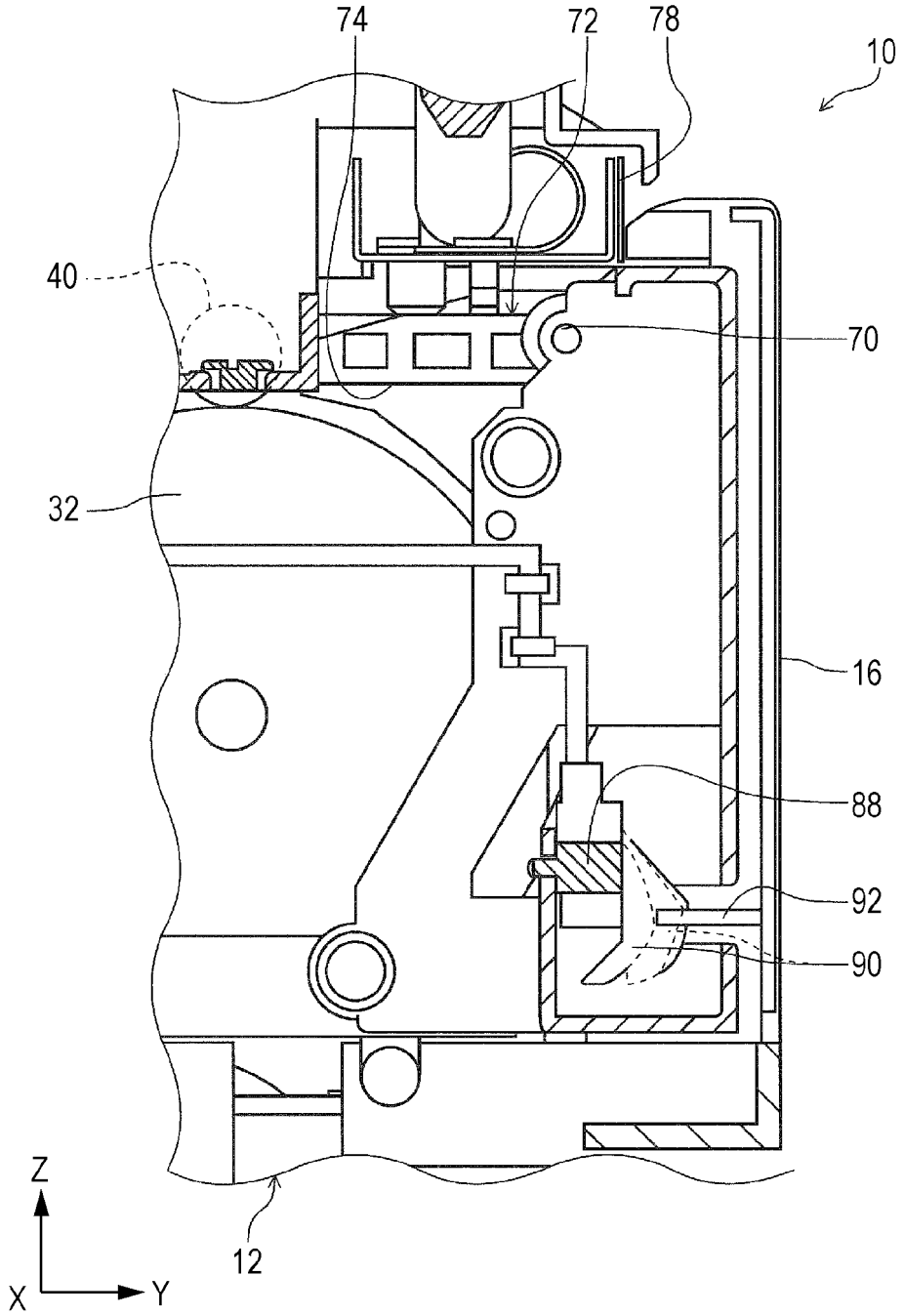
FIG. 10 is an outline view of a detector that detects whether the rear surface cover is in a closed state with respect to the device main body.

FIG. 6A is a perspective view of a restricting unit in the first example, FIG. 6B is a perspective view of a target engaging unit that engages with the restricting unit on the rear surface cover, FIG. 7A is a lateral view that shows a first state of the restricting unit, FIG. 7B is a lateral view that shows a second state of the restricting unit, FIG. 8 is an outline view that shows a rear surface cover biasing member that is provided on the rear surface cover, FIG. 9 is an enlarged view that shows the rear surface cover biasing member that is provided on the rear surface cover, and FIG. 10 is an outline view of a detector that detects whether the rear surface cover is in a closed state with respect to the device main body.

Figure 11:
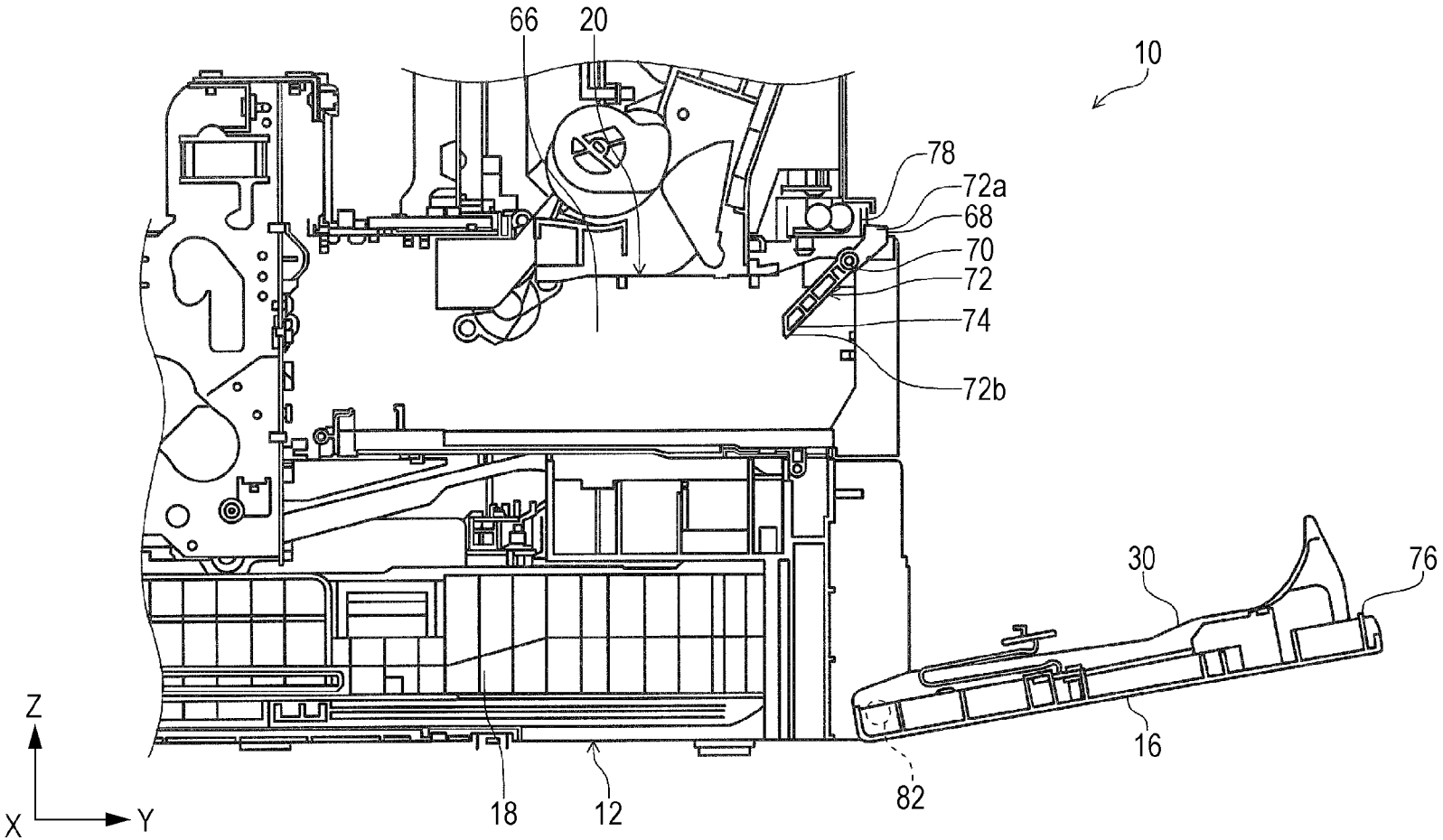
FIG. 11 is a sectional side view that shows a second state of the restricting unit in a state in which the rear surface cover is open with respect to the device main body and the unit body is removed.
Figure 12:
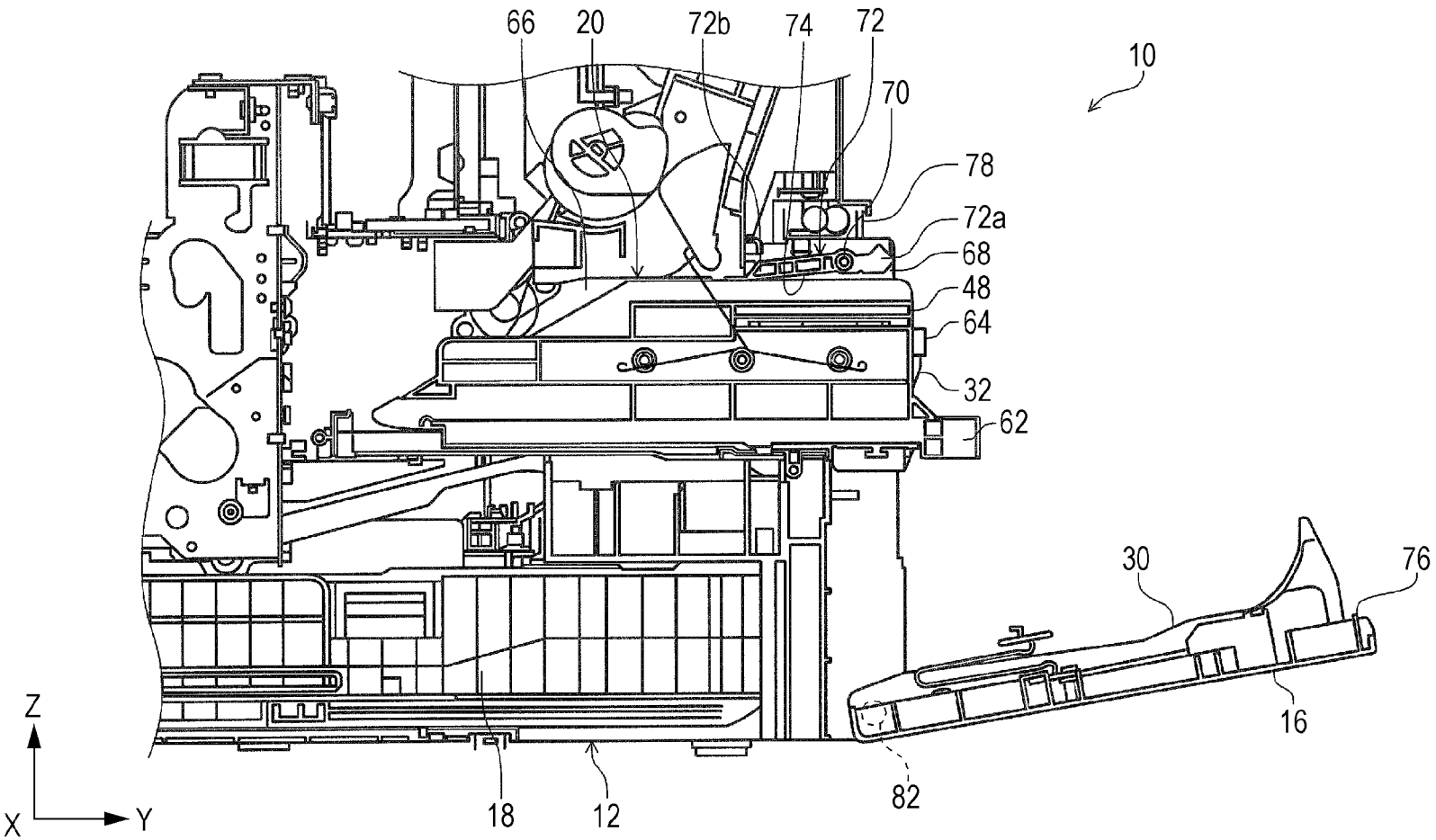
FIG. 12 is a sectional side view that shows a state in which the unit body is fixed to the device main body and the restricting unit is changed from the second state to the first state in a state in which the rear surface cover is open with respect to the device main body.
Figure 13:
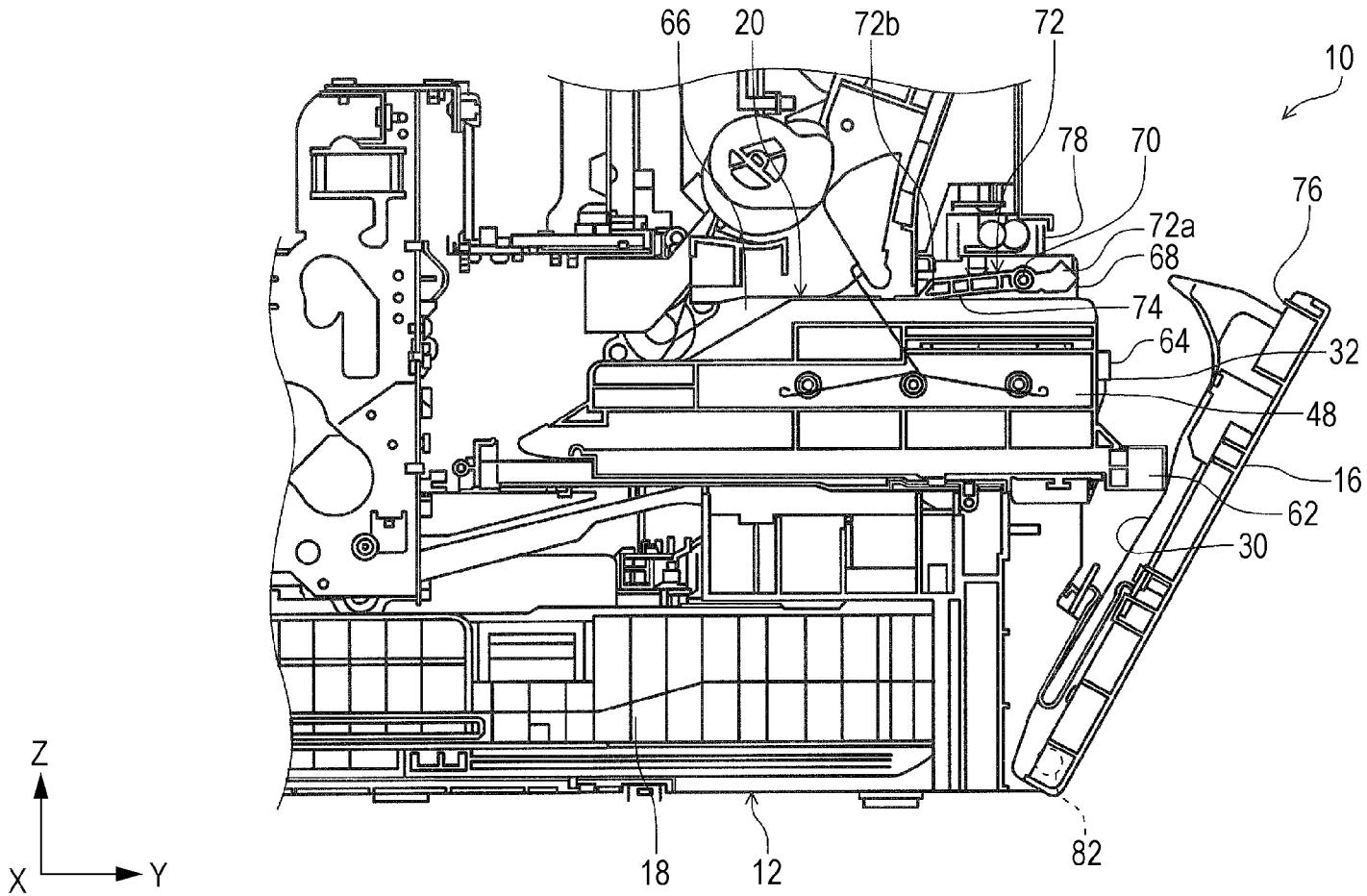
FIG. 13 is a sectional side view that shows a state of attempting to close the rear surface cover with respect to the device main body.
Figure 14:
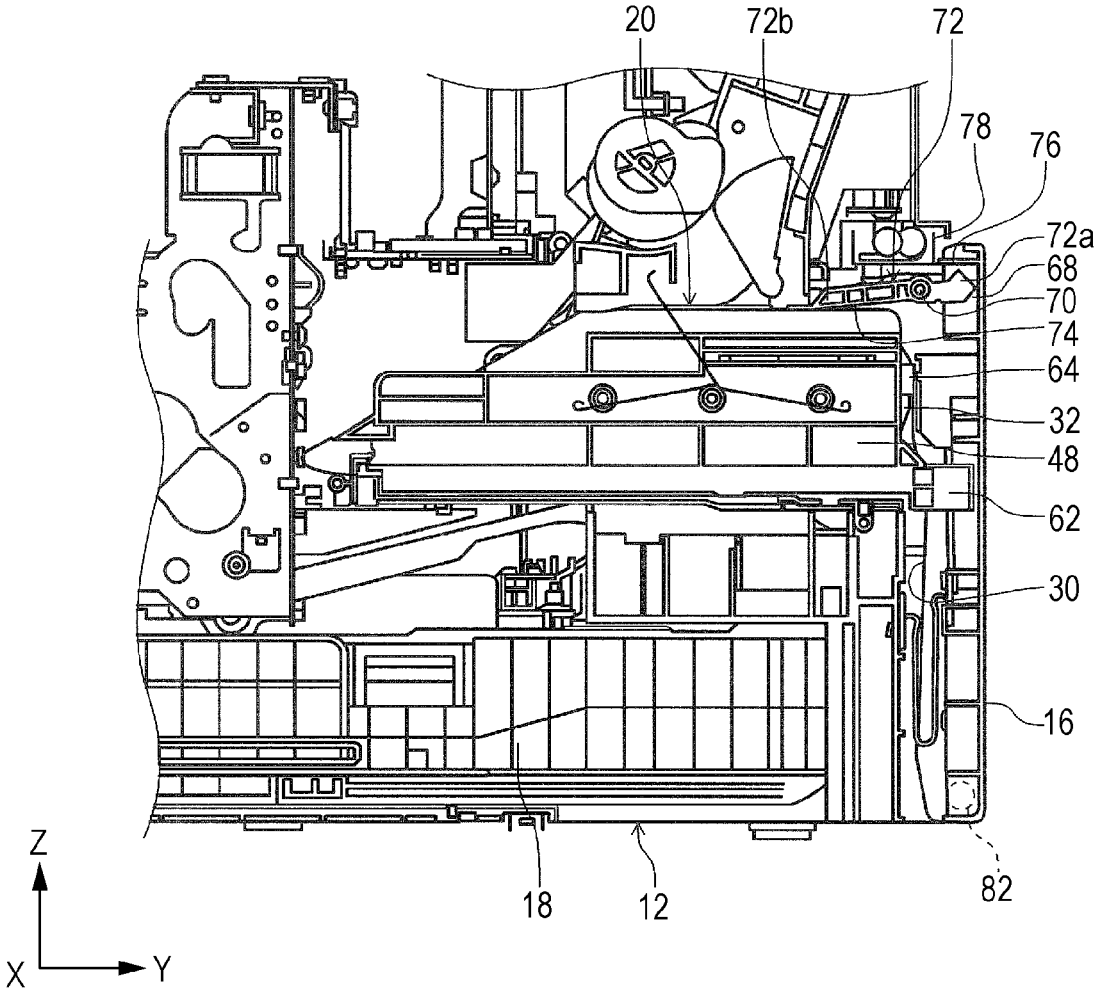
FIG. 14 is a sectional side view that shows a state in which the rear surface cover is closed with respect to the device main body.
Figure 15A:
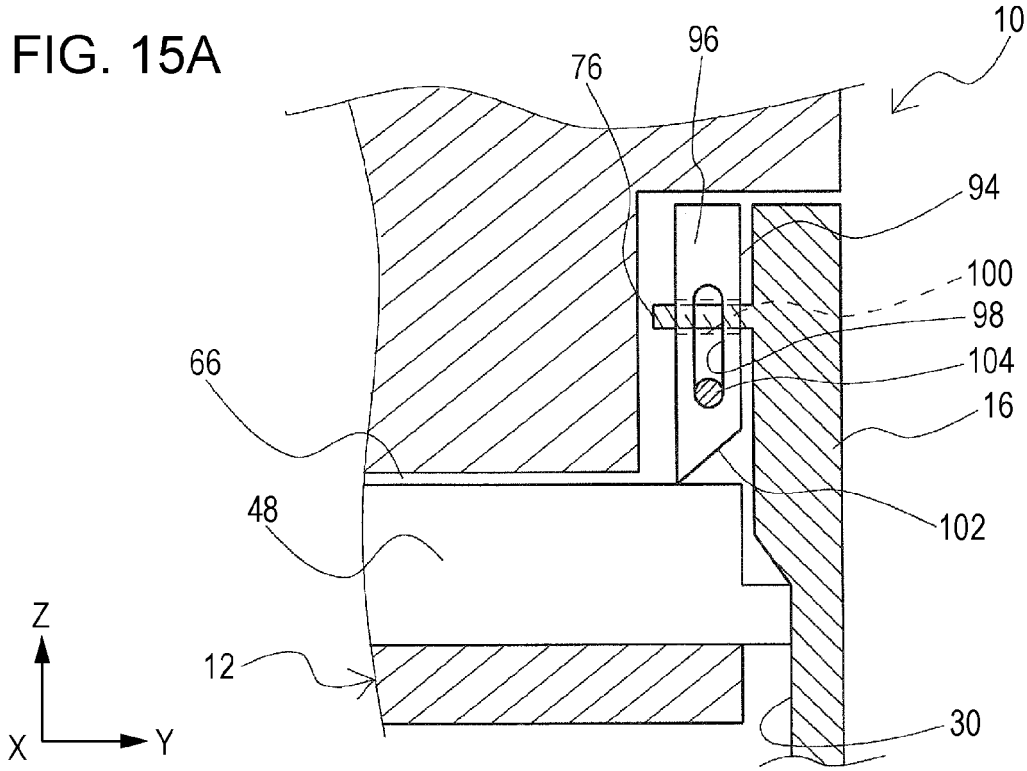
FIG. 15A is a lateral view that shows a first state of a restricting unit in a second example.
Figure 15B:
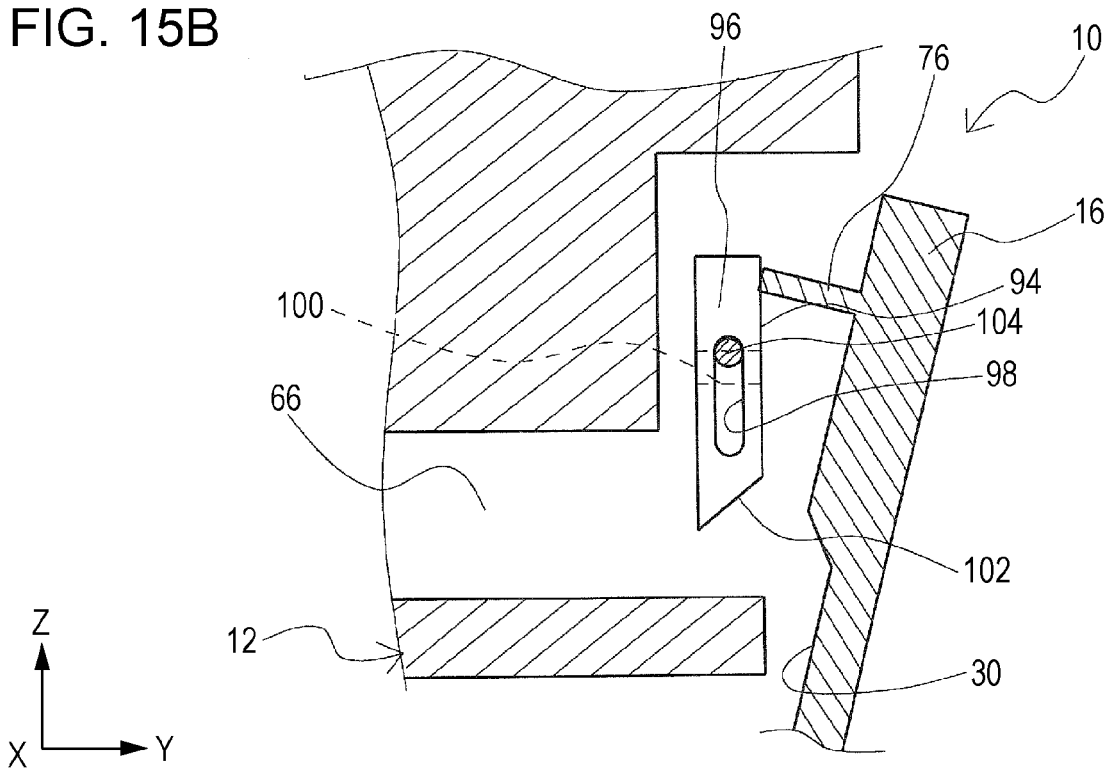
FIG. 15B is a lateral view that shows a second state of the restricting unit in the second example.

FIG. 11 is a sectional side view that shows a second state of the restricting unit in a state in which the rear surface cover is open with respect to the device main body and the unit body is removed, FIG. 12 is a sectional side view that shows a state in which the unit body is fixed to the device main body and the restricting unit is changed from the second state to the first state in a state in which the rear surface cover is open with respect to the device main body, FIG. 13 is a sectional side view that shows a state of attempting to close the rear surface cover with respect to the device main body, FIG. 14 is a sectional side view that shows a state in which the rear surface cover is closed with respect to the device main body, FIG. 15A is a lateral view that shows a first state of a restricting unit in a second example, and FIG. 15B is a lateral view that shows a second state of the restricting unit in the second example.

In addition, in an X-Y-Z coordinate system that is shown in each drawing, the X direction shows a scanning direction of a recording head, the Y direction shows a depth direction of the recording device, and the Z direction shows a direction of change in a distance (gap) between the recording head and a medium, that is, a device height direction. Additionally, in each drawing, a −Y direction is set as a recording device front surface side and a +Y direction is set as a recording device rear surface side.

Outline of Printer

Upon referring to FIG. 1, it is clear that a printer 10 according to the invention is shown. The printer 10 is provided with a device main body 12, and a manuscript reading device 14 that is provided above the device main body 12 to be rotatable with respect to the device main body 12. The device main body 12 is provided with a rear surface cover 16, which in configured to be rotatable with respect to the device main body 12 with a rotation axis 82 (refer to FIG. 2) as the center of rotation thereof, on a device rear surface side (a side in the +Y direction in FIG. 1). Additionally, in FIG. 1, the rear surface cover 16 is in a closed state with respect to the device main body 12.

Next, a transport pathway of a sheet P as a "target recording medium" in the printer 10 will be described with reference to FIG. 2. In the device main body 12, the printer 10 is provided with a medium accommodation unit 18, a transport unit 20, a recording unit 22, a discharge unit 24, and a control unit that is not shown in the drawings. The device main body 12 in the present example is provided with at least a portion of the transport unit 20, the recording unit 22, and the discharge unit 24.

The medium accommodation unit 18 is provided with a paper supply cassette 26 that is positioned on a lower side in a Z axis direction of the printer 10 in FIG. 2. The paper supply cassette 26 is configured to be capable of being installed and removed with respect to the device main body 12 from a device front side (a side in the −Y direction in FIG. 2).

Feeding rollers 28 and 28 that are rotationally driven by a drive source that is not shown in the drawings, are provided above the paper supply cassette 26. In addition, a base plate 26*a* of the paper supply cassette 26 is configured as a hopper that supports sheets P, and biases sheets P toward the feeding roller 28 that is positioned in the +Z axis direction in FIG. 2.

When a sheet P that is accommodated in the paper supply cassette 26 is fed to a downstream side in the transport pathway due the control of the control unit, which is not shown in the drawings, by coming into contact with a top sheet P that is accommodated in the paper supply cassette 26 and rotating, the feeding roller 28 delivers the top sheet P from the paper supply cassette 26 to the downstream side in the transport pathway.

In addition, when the rear surface cover 16 is in a closed state with respect to the device main body 12, an inner surface thereof configures a portion of the transport pathway of the sheet P. That is, a feeding pathway unit 30 that is formed on an inner side of the rear surface cover 16 guides the sheet P that is delivered from the paper supply cassette 26 to the transport unit 20.

The transport unit 20 is provided with a reverse roller 32, a transport drive roller 34, a first transport driven roller 36, a second transport driven roller 38, a third transport driven roller 40, a fourth transport driven roller 42, fifth transport driven roller 44, and a pair of transport rollers 46. In addition, the reverse roller 32 and the transport drive roller 34 configure a unit body 48 (refer to FIG. 5) that is attachable and detachable with respect to the device main body 12. A detailed account of the unit body 48 will be given later.

Additionally, in the present example, the reverse roller 32 and the transport drive roller 34 are respectively are rotationally driven in an anti-clockwise direction in FIG. 2 by a common drive source, which is not shown in the drawings, when the unit body 48 is fixed to the device main body 12 and the rear surface cover 16 is in a closed state with respect to the device main body 12.

In the transport unit 20, the sheets P are transported to the transport rollers 46 using the fifth transport driven roller 44 and the third transport driven roller 40 that abut against the reverse roller 32 along the transport pathway, and the second transport driven roller 38 and the first transport driven roller 36 that abut against the transport drive roller 34. The recording unit 22 is provided on the downstream side in the transport pathway of the transport rollers 46 in the transport unit 20.

The recording unit 22 is provided with a carriage 50 that is capable of moving in a scanning direction (the X axis direction in FIG. 2), a recording head 52 that is provided in a lower portion of the carriage 50 and ejects ink onto the sheets P, and a platen 54 that opposes the recording head 52 and is provided so as to support the sheets P.

Furthermore, the discharge unit 24 is provided on the downstream side in the transport pathway of the recording unit 22. A pair of discharge rollers 56 are provided in the discharge unit 24. Recording is executed on a first surface of sheets P that are sent along the transport pathway from the transport unit 20 to the recording unit 22. After the execution of recording, the sheets P are nipped by the discharge rollers 56, and discharged to a device front side.

In addition, in a case of performing recording on both sides of a sheet P in the printer 10, after recording has been performed on the first surface of the sheet P using the recording unit 22, a side of the sheet P that was a sheet tail end when recording on the first surface was executed becomes a lead end due to a backward feeding operation of the transport rollers 46 and the discharge rollers 56, and the sheet P is sent to a reverse pathway 58 that, in FIG. 2, is positioned on a side in the −Z direction of the transport drive roller 34 in the Z axis direction, that is, below the unit body 48 that will be described later. The reverse pathway 58 is provided below the reverse roller 32 and the transport drive roller 34, that is, along the −Z direction in FIG. 2, and is provided so as to converge with the transport pathway of the sheets P from the medium accommodation unit 18.

Further, the sheets P are sent from the reverse pathway 58 to the recording unit 22 again through the transport pathway, the reverse roller 32 and a transport pathway that is positioned above the transport drive roller 34, and recording on a second surface is executed. Further, after the execution of recording, the sheets P are nipped by the discharge rollers 56, and discharged to a device front side.

First Example

Configuration of Transport Unit

Next a detailed account of the transport unit 20 will be given with reference to FIG. 2. Additionally, the dashed-dotted line in FIG. 2 shows a medium transport pathway from the medium accommodation unit 18, and the broken line shows the reverse pathway 58 of the sheets P. The reverse roller 32 and the transport drive roller 34 are provided in positions that overlap with one another in the Z axis direction in FIG. 2. Therefore, it is possible to cut the dimensions of a disposition region of the reverse roller 32 and the transport drive roller 34 in the Z axis direction down to the bare minimum.

In addition, the reverse roller 32 and the transport drive roller 34 are disposed with an interval in the Y axis direction in FIG. 2. That is, in the transport pathway of the sheets P, the reverse roller 32 is positioned on the upstream side in the transport pathway, and the transport drive roller 34 is positioned on the downstream side in the transport pathway. In addition, the interval is set to be smaller than a minimum length in the direction of the transport pathway of the sheets P that can be handled in the printer 10.

Furthermore, in a device front-back direction (the Y axis direction in FIG. 2) with respect to the recording head 52 of the recording unit 22, the reverse roller 32 and the transport drive roller 34 are positioned on a back side (the +Y direction) with respect to a disposition region of the recording head 52, and are provided in a position that overlaps with the disposition region of the recording head 52 in a device height direction (the Z axis direction). Therefore, it is possible to suppress the an increase in the dimensions of the device height direction (the Z axis direction) by avoiding superimposition of the disposition region of the recording head 52 and the disposition region of the reverse roller 32 and the transport drive roller 34 in the device height direction (the Z axis direction).

In addition, in the reverse pathway 58 that is shown by the broken line in FIG. 2, a pathway length is set to be longer than a maximum length in the direction of the transport pathway of the sheets P that can be handled in the printer 10 so that a lead end side and a tail end side in the transport direction of the sheets P do not overlap in the reverse transport pathway.

As a result of this configuration, it is possible to suppress an increase in the diameter of the reverse roller 32, and it is possible to secure a sufficient length of the reverse pathway 58 for reversing the sheets P with the transport drive roller 34. In addition, since the transport drive roller 34 can apply a transport force to the reverse pathway 58 of the sheets P before reversal and the transport pathway after reversal, it is possible to suppress an increase in cost since it is possible to reduce the number of roller that are disposed.

Configuration of Unit Body

The unit body 48 that configures a portion of the transport unit 20 will be described with reference to FIGS. 3 to 5. The unit body 48 is configured to be attachable and detachable with respect to the device main body 12. As shown in FIG. 3, the unit body 48 is fixed to a unit body 60 so that the reverse roller 32 and the transport drive roller 34 are rotatable. In addition, first target pressing units 62 and second target pressing units 64 are provided on a side of the back end (the side in the +Y axis direction in FIG. 3) of the unit body 48.

The first target pressing units 62 are provided in lower portions of the unit body 48, and protrude toward the side in the +Y axis direction from the side of the back end (the side in the +Y axis direction in FIG. 3) of the unit body 48. In addition, the second target pressing units 64 are formed on the side of the back end (the side in the +Y axis direction in FIG. 3) of the unit body 48 so as to be positioned on the unit body 48 further toward an upper surface 48*a* of the unit body 48, that is, a side in the +Z axis direction in FIG. 3 than the first target pressing units 62.

In addition, in the present example, the reverse roller 32 and the transport drive roller 34 are disposed in a central portion in a width direction (the X axis direction in FIG. 3) of the unit body 60. In addition, the reverse roller 32 is disposed on a side of the back end (the side in the +Y direction in FIG. 3) of the unit body 60. The transport drive roller 34 is disposed at an interval on a side in the −Y direction from the reverse roller 32.

In addition, in the present example, the reverse roller 32 and the transport drive roller 34 are set to have the same diameter. Therefore, it is possible to achieve a reduction in cost since it is possible to configure the reverse roller 32 and the transport drive roller 34 with a common member. In addition, since the reverse roller 32 and the transport drive roller 34 have the same diameter, it is possible to easily equalize the circumferential speeds of the roller outer circumferences, that is, the sheet transport speeds by making the number of rotations of both rollers to be the same. In addition, by making the reverse roller 32 and the transport drive roller 34 have the same diameter, it is possible to keep a sheet P that is transported in the transport pathway that is formed between the unit body 60 and the device main body 12 flat.

In addition, since it is possible to equalize the sheet transport speeds in the reverse roller 32 and the transport drive roller 34, a pulling force is not applied to the sheets P between the reverse roller 32 and the transport drive roller 34, or the sheets P are not curved. As a result of this configuration, it is possible to favorably transport the sheets P along the transport pathway.

In addition, as shown in FIG. 4, if the rear surface cover 16 is opened with respect to the device main body 12, a back end portion of the unit body 48 that is provided on a side of the rear surface (the side in the +Y axis direction in FIG. 5) of the device main body 12, and is fixed to an installation unit 66 that accommodates the unit body 48 is exposed. As a result of this configuration, since a portion of the transport pathway of the sheets P that is formed by the reverse roller 32 that protrudes from the back end portion of the unit body 48 and the feeding pathway unit 30 of the rear surface cover 16 is exposed, it is possible to easily clear sheets P that are jammed during the occurrence of a sheet P jam (a paper jam).

FIG. 5 is a view that shows a state in which the unit body 48 is removed from the device main body 12. As shown in FIG. 4, during a state in which the rear surface cover 16 is open with respect to the device main body 12, it is possible for a user to draw out the unit body 48 from the installation unit 66 by grasping the first target pressing units 62 that are provided on the side of the back end (the side in the +Y axis direction in FIG. 3) of the unit body 48. Further, in this state, it is possible to remove the unit body 48 from the device main body 12. In this instance, since the first target pressing units 62 are configured so as to protrude from the back end portion (the side in the +Y axis direction in FIG. 3) of the unit body 48 with respect to the unit body 60, the first target pressing units 62 function as gripping portions when attaching the unit body 48 to and detaching the unit body 48 from the device main body 12.

Therefore, as a result of the first target pressing units 62 being configured as gripping portions when attaching the unit body 48 to and detaching the unit body 48 from the installation unit 66, it is possible to reduce cost since it is possible to make the configuration of the unit body 48 simple.

In addition, since the reverse roller 32 and the transport drive roller 34 configure the unit body 48 that is attachable and detachable with respect to the device main body 12, as shown in FIG. 5, by removing the unit body 48 from the installation unit 66 of the device main body 12, the reverse pathway 58 that is provided inside the device main body 12 is exposed. As a result of this, it is possible to easily remove sheets P that are jammed during the occurrence of a sheet P jam (a paper jam), from the reverse pathway 58 that is exposed.

Restricting Unit

Next a restricting unit 68 that restricts opening and closing of the rear surface cover 16 with respect to the device main body 12 will be described. Upon referring to FIG. 6A, it is clear that, in the present example, a swinging member 72 that is capable of swinging to a wall surface of a side in the −X axis direction in FIG. 5 with a swinging axis 70 as the center thereof is provided in the installation unit 66 that is open on the rear surface side (the side in the +Y axis direction in FIG. 5) of the device main body 12. The restricting unit 68 is provided in the swinging member 72 at a first end portion 72*a* with the swinging axis 70 as a swinging center thereof, and an engaging unit 74 is provided at a second end portion 72*b*.

In addition, in FIG. 6B, when the rear surface cover 16 is closed with respect to the device main body 12, a target restricting unit 76 is provided on a side (the side in the +Z direction in FIG. 6B) of the rear surface cover 16 that opposes the device main body 12. The target restricting unit 76 protrudes toward a side of the device main body 12 when the rear surface cover 16 is closed with respect to the device main body 12.

Upon referring to FIG. 7A, it is clear that the engaging unit 74 of the swinging member 72 is engaged with the upper surface 48*a* of the unit body 48 in a state in which the unit body 48 is fixed to the installation unit 66 of the device main body 12. As a result of this, the swinging member 72 is in a state in which the second end portion 72*b*, at which the engaging unit 74 is provided with the swinging axis 70 as a swinging center thereof, is lifted upwards to a side in the +Z direction in FIG. 7A by the unit body 48, or in other words, a state of being swung in a clockwise direction in FIG. 7A by the unit body 48.

In this state, since, as shown in FIG. 7A, the restricting unit 68 that is provided at the first end portion 72*a* is not in an engaging position with the target restricting unit 76 of the rear surface cover 16 when the an attempt to close the rear surface cover 16 with respect to the device main body 12 is made, it is possible to close the rear surface cover 16 with respect to the device main body 12. The orientation of the swinging member 72 in FIG. 7A, or in other words, the state of the restricting unit 68 is set as the first state of the restricting unit 68. That is, the restricting unit 68 allows the rear surface cover 16 to attain a closed state with respect to the device main body 12 when the restricting unit 68 is in the first state.

Next as shown in FIG. 7B, if the unit body 48 is removed from the installation unit 66 of the device main body 12, the swinging member 72 that is supported on the upper surface 48*a* of the unit body 48 swings, under its own weight, in an anti-clockwise direction in FIG. 7B with the swinging axis 70 as the center thereof. Further, the first end portion 72*a* of the swinging member 72 engages with a swinging restricting unit 78 that is provided in the device main body 12 in a state in which the restricting unit 68 faces toward a side of the −Y direction in FIG. 7B. As a result of this, the swinging of the swinging member 72 in the anti-clockwise direction is restricted.

In this state, if an attempt to close the rear surface cover 16 with respect to the device main body 12 is made, since the restricting unit 68 of the swinging member 72 is positioned in a pathway of displacement of the target restricting unit 76 of the rear surface cover 16, the restricting unit 68 engages with the target restricting unit 76 and it is no longer possible to close the rear surface cover 16 with respect to the device main body 12.

The orientation of the swinging member 72 in FIG. 7B, or in other words, the state of the restricting unit 68 is set as the second state of the restricting unit 68. That is, the restricting unit 68 restricts the rear surface cover 16 from attaining a closed state with respect to the device main body 12 when the restricting unit 68 is in the second state.

In addition, in the present example, since the swinging member 72 swings under its own weight, and the state of the restricting unit 68 changes from the first state to the second state, the state of the restricting unit 68 changes from the first state to the second state in tandem with the removal action of the unit body 48 from the installation unit 66 when the unit body 48 is removed from the installation unit 66 of the device main body 12. Therefore, it is possible to simplify the configuration of the restricting unit 68 since the state of the restricting unit 68 changes from the first state to the second state due to the weight of the restricting unit 68.

In addition, in the present example, since the restricting unit 68 is provided in the swinging member 72, and the restricting unit 68 is configured such that the state of the restricting unit 68 changes from the first state to the second due to the swinging of the swinging member 72, it is possible to reliably retain the second state when with respect to the device main body 12, the unit body 48 is in an uninstalled state with respect to the device main body 12, and it is possible to reliably restrict closing of the rear surface cover 16 in the device main body 12.

According to the present example, the unit body 48 that configures a portion of the transport pathway is configured to be attachable and detachable with respect to the device main body 12. The restricting unit 68 that is provided on a side of the device main body 12 can take on a first state that allows the rear surface cover 16 to attain a closed state with respect to the device main body 12 and a second state that restricts the rear surface cover 16 from attaining a closed state with respect to the device main body 12 depending on the attachment or detachment of the unit body 48 to the device main body 12. The restricting unit 68 changes from the first state to the second state in tandem with the removal action of the unit body 48 from the installation unit 66 when the unit body 48 is removed from the installation unit 66. As a result of this, the restricting unit 68 can restrict closing of the rear surface cover 16 in a state in which the unit body 48 is yet to be installed in the device main body 12. In addition, since it is not possible to close the rear surface cover 16 with respect to the device main body 12, it is possible for a user to easily confirm that the unit body 48 is yet to be installed in the device main body 12. In addition, since the restricting unit 68 changes from a first state to the second state in tandem with a removal action of the unit body 48 from the installation unit 66, workability is improved without it being necessary for a user to manipulate the restricting unit 68.

The present example will be discussed from a different point of view. The target restricting unit 76 of the rear surface cover 16 is associated with the movement of the rear surface cover 16 from an open state to a closed state, and follows an established track. The restricting unit 68 that is provided in the device main body 12 changes between the first state and the second state depending on an installation state of the unit body 48. That is, if the unit body 48 is installed in the device main body 12, the position of the restricting unit 68 follows the installation operation of the unit body 48, and migrates to a position that is shifted away from the track of the target restricting unit 76 of the rear surface cover 16. This is the first state in which the closed state of the rear surface cover 16 is possible. In addition, if the unit body 48 is removed from the device main body 12, the position of the restricting unit 68 follows the removal operation of the unit body 48, and is positioned on the track of the target restricting unit 76 of the rear surface cover 16. This is the second state in which a closing operation of the rear surface cover 16 is restricted.

Biasing Unit of Rear Surface Cover

Next a biasing unit of the rear surface cover 16 will be described with reference to FIGS. 8 and 9. A locking member 80 and a biasing spring 84 are provided on the rear surface cover 16 as "a biasing unit" on a side that is opposite a side on which the rotation axis 82 is provided, that is, a side of a free end (a side in the +Z axis direction in FIG. 8) of the rear surface cover 16. As shown in FIG. 9, the locking member 80 is configured so as to be capable of displacement along the Z axis direction in FIG. 9. The locking member 80 is provided with a first inclined surface 80*a* that is provided on a side in the −Y axis direction in FIGS. 8 and 9, and a second inclined surface 80*b* that is provided on a side in the +Y axis direction.

In addition, the biasing spring 84 biases the locking member 80 toward a side in the +Z axis direction in FIGS. 8 and 9. In addition, a locking member engaging unit 86 is provided on a side (a side in the +Y direction in FIGS. 8 and 9) of a back end of the device main body 12.

When an attempt to close the rear surface cover 16 with respect to the device main body 12 is made, the first inclined surface 80*a* in the locking member 80 engages with the locking member engaging unit 86 on the side of the device main body 12. Further, the locking member 80 follows the rotation of the rear surface cover 16 to the side of the device main body 12, resists a biasing force of the biasing spring 84 and is pushed onto a side in the −Z axis direction in FIGS. 8 and 9, and the locking member engaging unit 86 slides on the first inclined surface 80*a*. Further, if the locking member engaging unit 86 follows the rotation of the rear surface cover 16 to the side of the device main body 12, and passes over the first inclined surface 80*a* of the locking member 80, the locking member engaging unit 86 engages with the second inclined surface 80*b*.

Further, since the biasing spring 84 biases the locking member 80 toward the side of the +Z axis direction in FIGS. 8 and 9, the rear surface cover 16 receives a reactive force from the locking member engaging unit 86 that is engaged with the second inclined surface 80*b*, and is biased toward a side of the device main body, that is, in an anti-clockwise direction in FIGS. 8 and 9. Therefore, the rear surface cover 16 is biased using the locking member 80 and the biasing spring 84 so as to retain a closed state with respect to the device main body 12.

Detector of Rear Surface Cover

Next, a detector 88 that detects whether the rear surface cover 16 is in a closed state with respect to the device main body 12 will be described with reference to FIG. 10. In the present example, the detector 88 is provided on the side of the device main body 12. A switch 90 that is capable of being displaced in the Y axis direction in FIG. 10 is provided in the detector 88. The detector 88 is configured by a configuration that turns an electric circuit on and off due to displacement of the switch 90, and either a proximity sensor, a photo sensor or the like.

In addition, a switch engaging unit 92 is formed on the rear surface cover 16. When the rear surface cover 16 is closed with respect to the device main body 12, the switch engaging unit 92 engages with the switch 90, and the switch 90 is displaced from a state of being separated from the detector 88 (refer to the portion of the broken line in FIG. 10) to a side of the detector 88 so as to come into contact with the detector 88 (refer to FIG. 10). As a result of this, the detector 88 detects whether the rear surface cover 16 is closed with respect to the device main body 12. In the detector 88, a detected detection signal is transmitted to the control unit (not shown in the drawings). Further, the control unit (not shown in the drawings) controls the recording operation of the printer 10 on the basis of the detection signal. In other words, in a state in which the detection signal is yet to be received, the control unit (not shown in the drawings) restricts the execution of the recording operation of the printer 10.

In addition, in the present example, as shown in FIG. 6A, the detector 88 and the switch 90 are disposed in the installation unit 66 of the device main body 12 on a side in the −X axis direction in FIG. 6A, that is, a side on which the swinging member 72 is provided. Therefore, in a case in which the rear surface cover 16 has a low rigidity, even if an end portion of a side of the rear surface cover 16 in the +X axis direction in FIG. 6A is closed with respect to the device main body 12, since an end portion of a side in the −X axis direction is restricted and is not closed due to the restricting unit 68, the detector 88 cannot detect a state in which the rear surface cover 16 is closed. As a result of this, it is possible to reduce false detection in the detector 88.

Therefore, since the detector 88 that detects whether the rear surface cover 16 is in a closed state with respect to the device main body 12, and the restricting unit 68 that is provided in the swinging member 72 are disposed on the same side of the installation unit 66 in a direction that intersects the transport direction of the sheets P, it is possible to reduce false detection of the open and closed states of the rear surface cover 16. Therefore, it is possible to prevent operation of the printer 10 in a state in which the rear surface cover 16 is not closed normally with respect to the device main body 12.

Actions when Closing Rear Surface Cover in Device Main Body 12

Next the actions of the unit body 48, the restricting unit 68 and the first target pressing units 62 when an attempt to close the rear surface cover 16 with respect to the device main body 12 is made will be described with reference to FIGS. 11 to 14.

FIG. 11 shows a state in which the rear surface cover 16 is open with respect to the device main body 12 and the unit body 48 is removed from the installation unit 66. In this state, the swinging member 72 swings under its own weight, and the first end portion 72*a* is in a state of being engaged with the swinging restricting unit 78, that is, the restricting unit 68 is in the second state.

Next, as shown in FIG. 12, the unit body 48 is inserted into the installation unit 66 of the device main body 12 from a side of the +Y axis direction in FIG. 12. At this time, a user can perform a fixing operation to the device main body 12 by holding the first target pressing units 62, which also function as gripping portions of the unit body 48 with their hands.

In addition, if the unit body 48 is inserted into the installation unit 66, the engaging unit 74 of the swinging member 72 is pressed into the unit body 48 and swung in a clockwise direction in FIG. 12. Further, the engaging unit 74 engages with the upper surface 48*a* of the unit body 48. In other words, the restricting unit 68 of the swinging member 72 changes from the second state to the first state. Therefore, a restricted state with respect to the rear surface cover 16 that is due to the restricting unit 68, is released.

As a result of this, when the unit body 48 is installed in the installation unit 66, since the restricting unit 68 is displaced from the second state to the first state in tandem with the installation action of the unit body 48 in the installation unit 66, workability is improved without it being necessary for a user to manipulate the restricting unit 68.

As shown in FIG. 13, the rear surface cover 16 is rotated with respect to the device main body 12 in an anti-clockwise direction in FIG. 13 with the rotation axis 82 as the rotation center thereof. Further, a device main body 12 side of the rear surface cover 16, that is, a side on which the feeding pathway unit 30 is provided, and the first target pressing units 62 of the unit body 48 come into contact. Furthermore, as a result of rear surface cover 16 being rotated in the anti-clockwise direction, the rear surface cover 16 presses the first target pressing units 62. Further, the unit body 48 is displaced to a side in the −Y axis direction in FIG. 13 of the installation unit 66 as a result of being biased from the rear surface cover 16 through the first target pressing units 62.

Further, as shown in FIG. 14, the rear surface cover 16 attains a closed state with respect to the device main body 12. At this time, the unit body 48 is positioned in a position inside the installation unit 66 by being biased by the rear surface cover 16 up to a position inside the installation unit 66 at which the unit body 48 configures a portion of the transport pathway inside the device main body 12.

Additionally, in this instance, the position at which the unit body 48 configures a portion of the transport pathway inside the device main body 12 is a position of the unit body 48 inside the installation unit 66 at which the reverse roller 32 of the unit body 48 abuts against the third transport driven roller 40 and the transport drive roller 34 abuts against the first transport driven roller 36 and the second transport driven roller 38.

Therefore, when the unit body 48 is inserted into the installation unit 66 that is exposed when the rear surface cover 16 is opened with respect to the device main body 12, and the rear surface cover 16 is closed with respect to the device main body 12, since the unit body 48 is positioned in a position in which the unit body 48 configures a portion of the transport pathway of sheets P as a result of the rear surface cover 16 pressing the first target pressing units 62 that is provided in the unit body 48, it is possible for a user to reliably position the unit body 48 inside the device main body 12 by merely inserting the unit body 48 into the installation unit 66 and closing the rear surface cover 16. Furthermore, it is possible to improve the workability of the fixing operation of the unit body 48 to the device main body 12.

In addition, by providing the first target pressing units 62 on a side of the unit body 48 that opposes the rear surface cover 16, that is, on the side of the back end portion so as to protrude toward the side of the rear surface cover 16, it is possible to reliably engage the rear surface cover 16 with the first target pressing units 62 when the rear surface cover 16 is closed with respect to the device main body 12.

In addition, in a state in which the rear surface cover 16 is closed with respect to the device main body 12, since the rear surface cover 16 is biased toward a side in the −Y direction in FIG. 14 through the locking member 80 by the biasing force of the biasing spring 84, the unit body 48 is biased toward a position that configures a portion of the transport pathway inside the device main body 12. Therefore, when the rear surface cover 16 is closed with respect to the device main body 12, since the printer 10 is provided with the locking member 80 and the biasing spring 84 that bias the rear surface cover 16 toward the side of the device main body 12, it is possible to bias the unit body 48 toward a position inside the device main body 12 that configures a portion of the transport pathway of sheets P inside the device main body 12, and it is possible to secure the position of the unit body 48 in the installation unit 66.

In addition, in a state in which the rear surface cover 16 is closed with respect to the device main body 12, the second target pressing units 64 is biased in the unit body 48 toward the rear surface cover 16. In this instance, in the unit body 48, the second target pressing units 64 are positioned further on a side of the upper surface 48*a* of the unit body 48 than the first target pressing units 62.

As a result of this, when the unit body 48 is installed in the installation unit 66, a distance between a position in the Z axis direction in FIG. 14 at which the second target pressing units 64 and the rear surface cover 16 come into contact, and the rotation axis 82 is longer than a distance between a position at which the first target pressing units 62 and the rear surface cover 16 come into contact, and the rotation axis 82.

Therefore, the biasing force that is due to the rear surface cover 16 and that biases using the second target pressing units 64 is greater than the biasing force that biases using the first target pressing units 62. Therefore, it is possible to reliably secure the position of the unit body 48 in the installation unit 66 by biasing the unit body 48 with a greater force.

In addition, since the second target pressing units 64 are biased toward the side of the device main body 12 by the rear surface cover 16 when the rear surface cover 16 is closed with respect to the device main body 12 in a state in which the unit body 48 is fixed to the installation unit 66, it is possible to bias a position of the unit body 48 with respect to the device main body 12 to a position that configures a portion of the transport pathway, and it is possible to secure the position of the unit body 48.

Furthermore, since the second target pressing units 64 of the unit body 48 are biased toward the side of the device main body 12 by the rear surface cover 16, the reverse roller 32 is biased toward the third transport driven roller 40 and the transport drive roller 34 is biased toward the first transport driven roller 36 and the second transport driven roller 38, and therefore a transport force that transports the sheets P is generated between the abovementioned rollers. Therefore, when a sheet P passes between the rollers, the sheet P is reliably nipped in the rollers, and is transported along the transport direction.

The present example will be discussed from a different point of view. When the unit body 48 is inserted into the installation unit 66 and the rear surface cover 16 is closed with respect to the device main body 12, the rear surface cover 16 presses the first target pressing units 62 and thereafter, the rear surface cover 16 presses the second target pressing units 64. As a result of this operation, the unit body 48 is positioned in a position that configures a portion of the transport pathway.

In addition, when the rear surface cover 16 is open with respect to the device main body 12, since a biasing force that biased the unit body 48 no longer acts on the unit body 48, the nipping state of the reverse roller 32 and the third transport driven roller 40, the nipping state of the transport drive roller 34 and the first transport driven roller 36, and the nipping state of the transport drive roller 34 and the second transport driven roller 38 are released. As a result of this, it is possible to easily draw out sheets P from the transport unit 20.

Second Example

A restricting unit 94 according to a second example of the invention will be described with reference to FIGS. 15A and 15B. The restricting unit 94 differs from the first example in that the restricting unit 94 is provided in a sliding member 96 that is capable of moving in a sliding manner in the Z axis direction in FIGS. 15A and 15B.

Upon referring to FIG. 15A, it is clear that the sliding member 96 is provided with the restricting unit 94 that is provided on a side of the sliding member 96 that opposes the rear surface cover 16, an elongated hole 98 that extends in the Z axis direction, a penetration hole 100 that penetrates the sliding member 96 in the Y axis direction, and an inclined portion 102 that is provided at a lower end portion of the sliding member 96, and is inclined on a side in the +Y direction.

In addition, a fixing pin 104 is provided in the device main body 12. The fixing pin 104 is inserted into the elongated hole 98. Therefore, the sliding member 96 is configured so as to be moveable in a sliding manner along the Z axis direction with respect to the fixing pin 104.

In FIG. 15A, if the unit body 48 is fixed to the installation unit 66 of the device main body 12, the sliding member 96 attains a state of being displaced in the +Z axis direction by the unit body 48. In this state, if the rear surface cover 16 is closed with respect to the device main body 12, the target restricting unit 76 of the rear surface cover 16 is inserted into the penetration hole 100 of the sliding member 96. In this state, since the restricting unit 94 is not positioned in an engaging position with the target restricting unit 76 of the rear surface cover 16, it is possible to close the rear surface cover 16 with respect to the device main body 12.

Therefore, the orientation of the sliding member 96 in FIG. 15A, or in other words, the state of the restricting unit 94 is set as the first state of the restricting unit 94. That is, the restricting unit 94 allows the rear surface cover 16 to attain a closed state with respect to the device main body 12 when the restricting unit 94 is in the first state.

Next, upon referring to FIG. 15B, it is clear that, if the unit body 48 that supports the sliding member 96 is removed from the installation unit 66 of the device main body 12, the sliding member 96 moves in a sliding manner, under its own weight, in a −Z axis direction with respect to the fixing pin 104.

As a result of this, a position of the penetration hole 100 of the sliding member 96 in the Z axis direction in FIG. 15B is displaced to a side in the −Z axis direction. As a result of the displacement, since a position in the Z axis direction of the target restricting unit 76 of the rear surface cover 16 does not match a position in the Z axis direction of the penetration hole 100 when an attempt to close the rear surface cover 16 with respect to the device main body 12 is made, the target restricting unit 76 comes into contact with the restricting unit 94.

As a result of this, in this state, it is not possible to close the rear surface cover 16 with respect to the device main body 12. Therefore, orientation of the sliding member 96 in FIG. 15B, or in other words, the state of the restricting unit 94 is set as the second state of the restricting unit 94. That is, the restricting unit 94 restricts the rear surface cover 16 from attaining a closed state with respect to the device main body 12 when the restricting unit 94 is in the second state.

In addition, in the present example, when the unit body 48 is removed from the installation unit 66, the restricting unit 94 changes from the first state to the second state in tandem with the removal action. In addition, when the unit body 48 is inserted in the installation unit 66, the inclined portion 102 engages with the unit body 48, and the sliding member 96 is displaced in a sliding manner in the +Z axis direction in FIGS. 15A and 15B. Therefore, when the unit body 48 is fixed to the installation unit 66, the restricting unit 94 changes from the second state to the first state in tandem with the fixing operation.

Therefore, since the restricting unit 94 is provided in the sliding member 96, and changes from the first state to the second state as a result of the sliding member 96 sliding in a height direction of the device main body 12, that is, the Z axis direction, it is possible to reliably retain the second state when the unit body 48 is in an uninstalled state with respect to the device main body 12, and it is possible to reliably restrict closing of the rear surface cover 16 in the device main body 12.

The present example will be discussed from a different point of view. The target restricting unit 76 of the rear surface cover 16 is associated with the movement of the rear surface cover 16 from an open state to a closed state, and follows an established track. The restricting unit 94 that is provided in the device main body 12 changes between the first state and the second state depending on an installation state of the unit body 48. That is, if the unit body 48 is installed in the device main body 12, while the penetration hole 100 of the sliding member 96 follows the installation operation of the unit body 48, and is positioned on the track of the target restricting unit 76 of the rear surface cover 16, the restricting unit 94 migrates away from the track of the target restricting unit 76. This is the first state in which the closed state of the rear surface cover 16 is possible. In addition, if the unit body 48 is removed from the device main body 12, while the penetration hole 100 of the sliding member 96 follows the removal operation of the unit body 48, and migrates away from the track of the target restricting unit 76 of the rear surface cover 16, the restricting unit 94 is positioned on the track of the target restricting unit 76 of the rear surface cover 16. This is the second state in which a closing operation of the rear surface cover 16 is restricted.

Modification Examples of First Example and Second Example (1) In the swinging member 72 in the first example and the sliding member 96 in the second example, the restricting units 68 and 94 are configured to change from the first state to the second state under their own weight, but in place of this configuration, the restricting units 68 and 94 may have configurations in which a biasing unit such as a spring, which biases toward a direction that changes from the first state to the second state, is provided in the swinging member 72 and the sliding member 96.

According to this configuration, since a biasing unit that biases from the first state to the second state are provided in the restricting units 68 and 94, it is possible to reliably change from the first state to the second state. As a result of this, it is possible to reliably retain the second state when the unit body 48 is in an uninstalled state with respect to the device main body 12, and it is possible to reliably restrict closing of the rear surface cover 16 in the device main body 12.

(2) In the first example and the second example, a configuration in which the detector 88 is provided on the side of the device main body 12 is used, but in place of this configuration, a configuration in which the detector 88 is provided on the side of the rear surface cover 16 may also be used.

(3) In the first example and the second example, a configuration in which the rear surface cover 16 biases the second target pressing units 64 of the unit body 48 when the rear surface cover 16 is closed with respect to the device main body 12, is used, but a configuration in which the second target pressing units 64 are not provided in the unit body 48, and the first target pressing units 62 are biased with the rear surface cover 16, may also be used.

(4) In the first example, a configuration in which the swinging member 72 in which the restricting unit 68 is provided, and the detector 88 are provided in the installation unit 66 on a wall surface of a side in the −X direction in FIG. 6A, is used, but in place of this configuration, a configuration in which the swinging member 72 and the detector 88 are provided on a wall surface of a side in the +X direction, may also be used.

(5) In the first example and the second example, a configuration in which the biasing unit that biases toward a side in the +Y direction in FIG. 2 is provided in the installation unit 66, and the unit body 48 is displaced from the device main body 12 toward a removal direction by the biasing force of the biasing unit when the rear surface cover 16 is open with respect to the device main body 12, may be used.

(6) In the present examples, as shown in FIG. 13, when the rear surface cover 16 is closed with respect to the device main body 12, a configuration in which the first target pressing units 62 of the unit body 48 are positioned further on a side of a free end of the rear surface cover 16 than a central portion of the side of the rotation axis 82 and the side of the free end of the rear surface cover 16 is used, but in place of this configuration, a configuration in which the first target pressing units 62 are positioned further on a side of the rotation axis 82 of the rear surface cover 16 than a central portion of the side of the rotation axis 82 and the side of the free end of the rear surface cover 16, may be used.

According to this configuration, since the first target pressing units 62 are positioned further on a side of the rotation axis 82 of the rear surface cover 16 than a central portion of the side of the rotation axis 82 and the side of the free end of the rear surface cover 16 in a state in which the unit body 48 is inserted in the installation unit 66, it is possible to push the unit body 48 inside the device main body 12 with a smaller force than when pushing the unit body 48 at a position that is close to the free end of the rear surface cover 16, and therefore it is possible to improve workability.

If the abovementioned descriptions are summarized, the printer 10 of the present embodiment is provided with a device main body 12 in which a recording head 52, which performs recording on sheets P, is provided, a rear surface cover 16 that is openable and closeable with respect to the device main body 12, an installation unit 66 that is provided in the device main body 12, and is exposed when the rear surface cover 16 is open with respect to the device main body 12, a unit body 48 that is attachable and detachable with respect to the installation unit 66 in a state in which the installation unit 66 is exposed, and that configures a portion of a transport pathway of the sheets P in a state of being installed in the installation unit 66, and restricting units 68 and 94 that are provided on a device main body 12 side, and that can take on a first state that allows the rear surface cover 16 to attain a closed state with respect to the device main body 12 and a second state that restricts the rear surface cover 16 from attaining a closed state with respect to the device main body 12 depending on the attachment or detachment of the unit body 48 to the device main body 12. The restricting units 68 and 94 take on the first state in a state in which the unit body 48 is installed in the installation unit 66, and changes from the first state to the second state in tandem with a removal action of the unit body 48 from the installation unit 66 when the unit body 48 is removed from the installation unit 66.

The restricting units 68 and 94 change from the first state to the second state under their own weight. The restricting unit 68 is provided in the swinging member 72 that is capable of swinging with the swinging axis 70 as the center thereof. The restricting unit 68 can take on the first state or the second state depending on the swinging of the swinging member 72.

The restricting unit 94 is provided in the sliding member 96 that slides along the height direction of the device main body 12. The restricting unit 94 can take on the first state or the second state depending on the sliding of the sliding member 96 in the height direction. The restricting units 68 and 94 are provided with a biasing unit that biases from the first state to the second state. When the unit body 48 is installed in the installation unit 66, the restricting units 68 and 94 are displaced from the second state to the first state in tandem with the installation action of the unit body 48 in the installation unit 66.

The detector 88 that detects whether the rear surface cover 16 is in a closed state with respect to the device main body 12 is provided in at least one of the device main body 12 and the rear surface cover 16. The restricting units 68 and 94 are disposed in the installation unit 66 in a direction that intersects the transport direction of the sheets P, that is, on a side (a side of the −X axis direction) of an end in the X axis direction. The detector 88 is disposed on the side (the side of the −X axis direction) of the end on which the restricting units 68 and 94 are disposed.

In addition, in the present embodiment, the restricting units 68 and 94 according to the aspects of the invention are applied to an ink jet printer as an example of a recording device, but it is also possible to apply the restricting units 68 and 94 generally to other liquid ejecting devices.

In this instance, liquid ejecting devices are not limited to the recording devices such as printers, copy machines and facsimiles, and the like in which an ink jet type recording head is used, and which perform recording on a target recording medium by ejecting ink from the recording head, and the term includes devices that eject, in place of ink, a liquid that corresponds to the application thereof, to a target ejecting medium that corresponds to a target recording medium by ejecting the liquid onto the target ejecting medium from a liquid ejecting head that corresponds to an ink jet recording head.

Other than the abovementioned recording head, examples of liquid ejecting heads include color material ejecting heads that are used in the production of color filters such as liquid crystal displays, electrode material (conductive paste) ejecting heads that are used in electrode formation such as organic EL displays, Field Emission Displays (FED) and the like, living organic material ejecting heads that are used in the production of biochips, and reagent ejecting heads as precision pipettes.

Additionally, the invention is not limited to the abovementioned examples, various alterations are possible within the range of the invention that is disclosed in the claims, and such alterations are included within the scope of the invention.

The entire disclosure of Japanese Patent Application No. 2013-181900, filed Sep. 3, 2013 is expressly incorporated by reference herein.

What is claimed is:

1. A medium transport device comprising:

a device main body that is provided with a transport unit that transports a medium;

a transport pathway that configures the transport unit;

an opening and closing body that is openable and closeable with respect to the device main body;

an installation unit that is provided in the device main body, and is exposed when the opening and closing body is open with respect to the device main body;

a unit body that is attachable and detachable with respect to the installation unit in a state in which the installation unit is exposed, and that configures a portion of the transport pathway in a state of being installed in the installation unit; and a restricting unit that is provided in the device main body, and that changes between a first state that allows the opening and closing body to attain a closed state with respect to the device main body and a second state that restricts the opening and closing body from attaining a closed state with respect to the device main body in tandem with an attaching and detaching operation of the unit body with respect to the device main body.

2. The medium transport device according to claim 1, wherein the opening and closing body is provided with a target restricting unit that is provided facing a device main body side, and that follows a track that is established according to an opening and closing operation of the opening and closing body, wherein, in the first state, the restricting unit migrates to a position that is shifted away from the track of the target restricting unit, and wherein, in the second state, the restricting unit is positioned on the track of the target restricting unit.

3. The medium transport device according to claim 2, wherein the restricting unit is provided in a swinging member, wherein the swinging member swings in tandem with the attaching and detaching operation of the unit body with respect to the device main body, wherein the swinging member positions the restricting unit in the first state by swinging in tandem with an installation operation of the unit body to the device main body, and wherein the swinging member positions the restricting unit in the second state by swinging in tandem with a removal operation of the unit body from the device main body.

4. The medium transport device according to claim 3, wherein the swinging member achieves the first state of abutting against the unit body as a result of the installation operation of the unit body in the device main body, and achieves the second state of swinging under its own weight as a result of the removal operation of the unit body from the device main body.

5. The medium transport device according to claim 2, wherein the restricting unit is provided in a sliding member, wherein the sliding member slides in tandem with the attaching and detaching operation of the unit body with respect to the device main body, wherein the sliding member positions the restricting unit in the first state by sliding in tandem with an installation operation of the unit body to the device main body, and wherein the sliding member positions the restricting unit in the second state by sliding in tandem with a removal operation of the unit body from the device main body.

6. The medium transport device according to claim 5, wherein the sliding member achieves the first state of abutting against the unit body as a result of the installation operation of the unit body in the device main body, and achieves the second state of sliding under its own weight as a result of the removal operation of the unit body from the device main body.

7. A recording device comprising:

a recording unit which is provided in the device main body according to claim 1, wherein the recording device executes recording on a medium that is transported by the transport unit using the recording unit.

* * * * *